US011062723B2

(12) United States Patent
Jensen et al.

(10) Patent No.: US 11,062,723 B2
(45) Date of Patent: Jul. 13, 2021

(54) ENHANCEMENT OF AUDIO FROM REMOTE AUDIO SOURCES

(71) Applicant: Bose Corporation, Framingham, MA (US)

(72) Inventors: Carl Jensen, Waltham, MA (US); Andrew Todd Sabin, Chicago, IL (US); Andrew Jackson Stockton, X, Jamaica Plain, MA (US); Daniel Ross Tengelsen, Framingham, MA (US); Marko Stamenovic, Jamaica Plain, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/782,692

(22) Filed: Feb. 5, 2020

(65) Prior Publication Data

US 2021/0082450 A1 Mar. 18, 2021

Related U.S. Application Data

(60) Provisional application No. 62/901,720, filed on Sep. 17, 2019.

(51) Int. Cl.
*G10L 21/0232* (2013.01)
*G10L 25/18* (2013.01)
(Continued)

(52) U.S. Cl.
CPC ..... *G10L 21/0232* (2013.01); *G10L 25/18* (2013.01); *H04R 1/406* (2013.01); *H04R 3/005* (2013.01); *G10L 2021/02166* (2013.01)

(58) Field of Classification Search
CPC ..... G10L 21/0232; G10L 25/18; G10L 2021/02166; H04R 3/04; H04R 1/406; H04R 3/005
(Continued)

(56) References Cited

U.S. PATENT DOCUMENTS 10,299,038 B2 5/2019 Kim et al.
2009/0020291 A1 1/2009 Wagner et al.
(Continued)

OTHER PUBLICATIONS

Erdogan et al., "Phase-sensitive and recognition-boosted speech separation using deep recurrent neural networks," IEEE, 2015, 5 pages.

(Continued)

*Primary Examiner* — Vivian C Chin
*Assistant Examiner* — Friedrich Fahnert
(74) *Attorney, Agent, or Firm* — Fish & Richardson P.C.

(57) ABSTRACT

An audio enhancement method includes receiving a first input signal representative of audio captured using an array of two or more sensors, the first input signal characterized by a first signal-to-noise ratio (SNR), with the audio being the signal-of-interest. The method also includes receiving a second input signal representative of the audio, the second input signal characterized by a second SNR. The second SNR is higher than the first SNR. The method further includes computing a spectral mask based on a frequency domain representation of the second input signal, and processing a frequency domain representation of the first input signal based on the spectral mask to generate one or more driver signals. The method further includes driving one or more acoustic transducers using the generated driver signals.

24 Claims, 13 Drawing Sheets

(51) Int. Cl.
*H04R 3/00* (2006.01)
*H04R 1/40* (2006.01)
*G10L 21/0216* (2013.01)

(58) Field of Classification Search
USPC ..... 381/94.7, 92
See application file for complete search history.

(56) References Cited

U.S. PATENT DOCUMENTS

2016/0295322 A1* 10/2016 Orescanin ..... G10L 21/0208
2017/0353805 A1 12/2017 Mustiere et al.

OTHER PUBLICATIONS

International Search Report and Written Opinion in International Appln. No. PCT/US2020/050989, dated Dec. 10, 2020, 11 pages.
Wang et al., "Oracle performance investigation of the ideal masks," IEEE, 2016, 5 pages.
Wang et al., "Time-frequency masking for speech separation and its potential for hearing aid design," Trends in Amplification, 2008, 12(4):346-349.

* cited by examiner

ENHANCEMENT OF AUDIO FROM REMOTE AUDIO SOURCES

PRIORITY CLAIM

This document claims priority to U.S. Provisional Application 62/901,720, filed on Sep. 17, 2019, the entire content of which is incorporated herein by reference.

TECHNICAL FIELD

This disclosure generally relates to the enhancement of audio originating from remote audio sources, for example, to improve the signal to noise (SNR) characteristic or spatial characteristic of audio perceived by a listener located remotely from the audio source.

BACKGROUND

A listener located at a substantial distance from a remote audio source may perceive the audio with degraded quality (e.g., low SNR) due to the presence of variable acoustic noise in the environment. The presence of noise may hide soft sounds of interest and lessen the fidelity of music or the intelligibility of speech, particularly for people with hearing disabilities. In some cases, the audio is collected at or near the remote audio source, e.g., using a set of remote microphones disposed on a portable device, and reproduced at the location of the listener over a set of acoustic transducers (e.g., headphones, or hearing aids). Because the audio is collected nearer to the source, the SNR of the captured audio can be higher than that of the audio at the location of the user. In some cases, the audio is collected at the location of the user, but is enhanced (e.g., using beamforming methods) so that the SNR of the enhanced audio is higher than that of non-enhanced audio captured at the location of the user.

SUMMARY

In one aspect, this document features a method for audio enhancement, the method including receiving a first input signal representative of audio captured using an array of two or more sensors. The first input signal is characterized by a first signal-to-noise ratio (SNR) wherein the audio is a signal-of-interest. The method also includes receiving a second input signal representative of the audio. The second input signal is characterized by a second SNR, with the audio being the signal-of-interest. The second SNR is higher than the first SNR. The method further includes computing a spectral mask based at least on a frequency domain representation of the second input signal, processing a frequency domain representation of the first input signal based on the spectral mask to generate one or more driver signals, and driving one or more acoustic transducers using the one or more driver signals to generate an acoustic signal representative of the audio.

In another aspect, this document features an audio enhancement system that includes an array of two or more sensors, a controller that includes one or more processing devices, and one or more acoustic transducers. The two or more sensors capture a first input signal representative of audio, wherein the first input signal is characterized by a first signal-to-noise ratio (SNR) with the audio being a signal-of-interest. The controller is configured to receive the first input signal, and receive a second input signal representative of the audio. The second input signal is characterized by a second SNR, with the audio being the signal-of-interest, wherein the second SNR is higher than the first SNR. The controller is also configured to compute a spectral mask based at least on a frequency domain representation of the second input signal, and process a frequency domain representation of the first input signal based on the spectral mask to generate one or more driver signals. The one or more acoustic transducers are driven by the one or more driver signals to generate an acoustic signal representative of the audio.

In another aspect, this document features one or more machine-readable storage devices storing instructions that are executable by one or more processing devices. The instructions, upon such execution, cause the one or more processing devices to perform operations that include receiving a first input signal representative of audio captured using an array of two or more sensors, the first input signal being characterized by a first signal-to-noise ratio (SNR) wherein the audio is a signal-of-interest. The operations also include receiving a second input signal representative of the audio, the second input signal being characterized by a second SNR, with the audio being the signal-of-interest. The second SNR is higher than the first SNR. The operations further include computing a spectral mask based at least on a frequency domain representation of the second input signal, processing a frequency domain representation of the first input signal based on the spectral mask to generate one or more driver signals, and driving one or more acoustic transducers using the one or more driver signals to generate an acoustic signal representative of the audio.

Implementations of the above aspects can include one or more of the following features. The frequency domain representation of the second input signal can include a first complex vector representing a spectrogram of a frame of the second input signal. Computing the spectral mask can include determining whether a magnitude of the first complex vector satisfies a threshold condition, and responsive to determining that the magnitude of the first complex vector satisfies the threshold condition, setting the value of the spectral mask to the magnitude of the first complex vector. On the other hand, responsive to determining that the magnitude of the first complex vector fails to satisfy the threshold condition, the value of the spectral mask can be set to zero. The frequency domain representation of the first input signal can include a second complex vector representing a spectrogram of a frame of the first input signal. Computing the spectral mask can include determining whether a magnitude of the second complex vector is larger than a magnitude of a difference between the first and second complex vectors, and responsive to determining that the magnitude of the second complex vector is larger than the magnitude of the difference between the first and second complex vectors, setting the value of the spectral mask to unity. On the other hand, responsive to determining that the magnitude of the complex vector fails to satisfy the threshold condition, the value of the spectral mask can be set to zero. Computing the spectral mask can include setting the value of the spectral mask to a value computed as a function of a ratio between (i) the magnitude of the first complex vector, and (ii) magnitude of the second complex vector. Computing the spectral mask can include setting the value of the spectral mask to a value computed as a function of difference between (i) a phase of the first complex vector, and (ii) a phase of the second complex vector. Processing the frequency domain representation of the first input signal based on the spectral mask can include generating an initial spectral mask from the frequency domain representation of multiple frames of the second input signal, performing a spectro-temporal smoothing process on the initial spectral mask to generate a smoothed spectral mask, and performing a point-wise multiplication between the frequency domain representation of the first input signal and the smoothed spectral mask to generate a frequency domain representation of the one or more driver signals. The second input signal can originate at a first location that is remote with respect to the array of two or more sensors. The second input signal can be captured by a sensor disposed at the first location, wherein the first location is closer to the source of the audio as compared to the array of two or more sensors. The second input signal can be derived from signals captured by a microphone array disposed on a head-worn device. The microphone array can include the array of two or more sensors. The second input signal can be derived from the signals captured by the microphone array using beamforming or SNR-enhancing techniques. The array of two or more sensors can include microphones disposed in a head-worn device.

In another aspect, this document features a method for audio enhancement, the method including receiving a first input signal representative of audio captured using an array of two or more sensors disposed at a first location, the first input signal being characterized by a first signal-to-noise ratio (SNR) wherein the audio is a signal-of-interest. The method also includes receiving a second input signal representative of the audio, the second input signal being characterized by a second SNR, with the audio being the signal-of-interest. The second SNR is higher than the first SNR. The method further includes combining the first input signal with the second input signal to generate one or more driver signals for one or more acoustic transducers of a head-worn acoustic device, and driving the one or more acoustic transducers using the one or more driver signals to generate an acoustic signal representative of the audio.

In another aspect, this document features a system that includes an array of two or more sensors, and a controller having one or more processing devices. The two or more sensors are configured to capture a first input signal representative of audio, the first input signal being characterized by a first signal-to-noise ratio (SNR) wherein the audio is a signal-of-interest. The controller is configured to receive the first input signal, and receiving a second input signal representative of the audio, the second input signal being characterized by a second SNR, with the audio being the signal-of-interest. The second SNR is higher than the first SNR. The controller is also configured to combine the first input signal with the second input signal to generate one or more driver signals for one or more acoustic transducers of a head-worn acoustic device, and drive the one or more acoustic transducers using the one or more driver signals to generate an acoustic signal representative of the audio.

In another aspect, this document features one or more machine-readable storage devices storing instructions that are executable by one or more processing device. The instructions, upon such execution, cause the one or more processing devices to perform operations that include receiving a first input signal representative of audio captured using an array of two or more sensors disposed at a first location, the first input signal being characterized by a first signal-to-noise ratio (SNR) wherein the audio is a signal-of-interest. The operations also include receiving a second input signal representative of the audio, the second input signal being characterized by a second SNR, with the audio being the signal-of-interest. The second SNR is higher than the first SNR. The operations further include combining the first input signal with the second input signal to generate one or more driver signals for one or more acoustic transducers of a head-worn acoustic device, and driving the one or more acoustic transducers using the one or more driver signals to generate an acoustic signal representative of the audio. In some implementations, the audio can be binaural or spatial audio having directional qualities desired by a user.

Implementations of the above aspects can provide one or more of the following advantages. By combining high-SNR audio captured by one or more off-head microphones with spatial information extracted from relatively low-SNR audio captured using head-worn devices such as headphones or hearing aids, the technology described herein can improve naturalness of the reproduced sounds in terms of improved spatial perception. For example, not only does a user hear sounds at a higher SNR, but also the sounds are perceived to come from the direction of their actual sources. This can significantly improve the user-experience for some users (e.g., hearing aid or other hearing assistance device users who use remote microphones placed closer to sound sources to hear higher SNR audio), for example, by improving speech intelligibility and general audio perception. In addition, because the technology described herein does not depend on any additional sensors apart from microphones, and also does not require any specific orientation of the off-head microphones, the technology is robust and easy to implement, possibly using microphones available on existing devices. Furthermore, in some cases, the technology described herein may obviate the need for off-head microphones altogether, reducing the complexity of audio enhancement systems. For example, the high-SNR audio can be generated using beamforming or other SNR-enhancing techniques on signals captured by an on-head microphone array.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

Figure 1A:
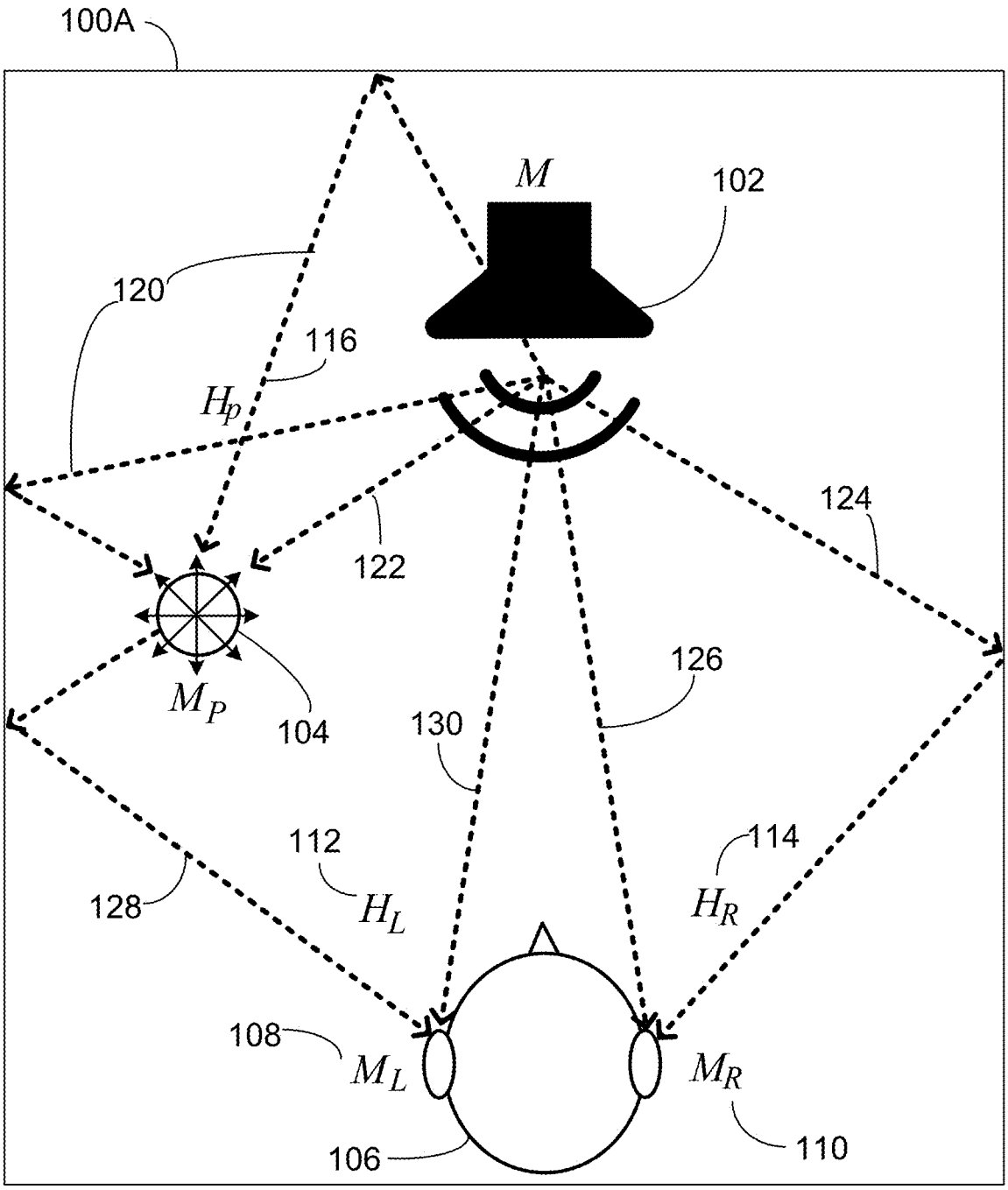
FIGS. 1A-1B are example environments in which the technology described can be implemented.

Users of hearing assistance devices such as hearing aids often use remote microphones to improve speech intelligibility and general audio perception. For example, on-head microphones on a hearing aid or other head-worn hearing assistance devices may not be sufficient to capture audio from an audio source located at a distance from the user. In such cases one or more off-head microphones disposed on a device can be placed closer to the remote audio source (e.g., an acoustic transducer or person) such that the audio captured by the off-head microphones are transmitted to the hearing aids of the user. While the audio captured by the one or more off-head microphones can have a higher signal-to-noise ratio (SNR) as compared to the audio captured by the on-head microphones, simply reproducing the high-SNR audio captured by the off-head microphones can cause the user to lose directional perception of the audio source. This document describes techniques for enhancing audio from such remote audio sources by combining the audio from the remote sources with spatial information extracted from audio captured using an array of on-head microphones.

In some implementations, audio enhancement of remote audio sources may be done without using off-head microphones. For example, a high-SNR audio signal can be derived from signals captured by an array of on-head microphones (e.g., using beamforming or other SNR-enhancing techniques). However, in such implementations, the high-SNR signal may still not have the same or substantially similar spatial characteristics as signals perceived by a user's ears, and can cause the user to lose directional perception of the audio source. This document further describes techniques for enhancing audio from remote audio sources by combining the high-SNR audio signal from an on-head microphone array with spatial information extracted from audio captured using microphones positioned at or near the user's ears (sometimes referred to herein as ear microphones).

If a listener is positioned at a substantial distance from an audio source, it can be challenging for the listener to hear the remotely generated audio due to low volume of the audio and/or the presence of noise in the environment. In some cases, the listener may hear the audio, but at low quality (e.g., poor fidelity of music or unintelligibility of speech). Traditional techniques for addressing this challenge include collecting a signal at or near the remote audio source and reproducing the signal at the listener's location. For example, a microphone array positioned near the audio source can collect the generated audio signal, or in some cases, the source signal itself (e.g., a driver signal to the speaker) can be collected directly. When reproduced to the listener at the listener's location, these collected audio signals may have higher SNR than what the listener would otherwise hear from the remote audio source. The SNR of these collected audio signals can be further increased using beamforming or other SNR-enhancing techniques. However, since the audio signals were not collected at the position of the listener, the reproduced audio can lack spatial characteristics that reflect the listener's position and orientation in the environment relative to the location of the audio source. This can detract from the listener's audio experience and potentially confuse the listener as she moves around since the audio source is perceived to be stationary relative to the listener (e.g., always in the "center" of the listener's head.)

This document features, among other things, novel techniques for enhancing audio from remote audio sources that can address one or more drawbacks of traditional systems and methods. For example, the technology described herein can increase the SNR of the audio perceived by the listener while maintaining spatial characteristics that reflect the listener's position relative to the audio source. In some implementations, the techniques described herein combine signals captured at the location of the listener with a signal received at the location of the remote audio source in order to achieve high SNR and maintain spatial information in the reproduced audio. In some implementations, a high-SNR signal derived from an on-head microphone array at the location of the user is combined with one or more signals received by ear microphones in order to achieve high SNR and maintain spatial information in the reproduced audio. In some implementations, combining the signals may include adaptive filtering techniques, angle-of-arrival (AoA) estimation techniques and/or spectral masking techniques further described herein.

The technology described herein may exhibit one or more of the following advantages. The technology can improve a listener's audio experience, by simultaneously allowing the listener to hear audio from a remote audio source and perceive the audio to be coming from the direction of the remote audio source. In addition, this technology can be more robust, less expensive, and easier to implement than alternative systems that require additional sensors beyond microphones or require a particular orientation of the listener's head.

FIG. 1A shows a first example environment 100A including an audio source 102, a microphone array $M_P$ (104), and a listener 106. The audio source 102 is positioned remotely from the listener 106, and is sometimes referred to herein as a "remote audio source." However, in some cases, if the audio source 102 is positioned remotely from the listener 106, then the listener 106 can be considered positioned remotely from the audio source 102, and vice versa. The listener 106 has microphones, $M_L$ (108) and $M_R$ (110), respectively positioned near the left ear and right ear of the listener 106. In some cases, microphones $M_L$ (108) and $M_R$ (110) can be referred to as on-head microphones and be disposed on a head-worn device (e.g., headsets, glasses, earbuds, etc.). In particular, in cases where microphones $M_L$ (108) and $M_R$ (110) are positioned at or near the listener's ears, the microphones $M_L$ (108) and $M_R$ (110) can be referred to as ear microphones. While $M_P$ (104) is described as a microphone array, in some implementations, $M_P$ (104) may be a single, monoaural microphone. In other implementations, $M_P$ (104) may include multiple microphones, for example, arranged in a microphone array such as those described in U.S. Pat. No. 10,299,038, which is fully incorporated by reference herein. In some cases, microphone array $M_P$ (104), may also be referred to as an off-head microphone 104.

The acoustic paths between the audio source 102 and the on-head microphones $M_L$ (108) and $M_R$ (110) can be characterized by transfer functions $H_L$ (112) and $H_R$ (114) respectively. Similarly, the acoustic path between the audio source 102 and the microphone array 104 can be characterized by a transfer function $H_P$ (116). Transfer function $H_L$ (112) includes both the direct arrival 130 and indirect arrival 128 of sound from the audio source 102; transfer function $H_R$ (114) includes both the direct arrival 126 and indirect arrival 124 of sound from the audio source 102; and transfer function $H_P$ (116) includes both the direct arrival 122 and the indirect arrivals 120 of sound from the audio source.

The inclusion within transfer functions $H_L$ (112), $H_R$ (114), and $H_P$ (116) of the direct arrival and indirect arrival paths from remote audio source 102 provides spatial information about the respective positions of microphones $M_L$ (108), $M_R$ (110), and $M_P$ (104) within the environment. For example, a listener that listens to the signals captured by microphones $M_L$ (108) and $M_R$ (110) may perceive that that he is located at the position of microphones $M_L$ (108) and $M_R$ (110) relative to the audio source 102. On the other hand, a listener that listens to the signals captured by microphone array $M_P$ (104) may perceive that she is located at the position of microphone array $M_P$ (104) relative to the audio source 102.

In general, humans are able to naturally perceive the spatial characteristics of audio based on various mechanisms. One mechanism is occlusion, wherein the presence of the listener's body changes the magnitude and timing of audio arriving at the listener's ears depending on the frequency of the sound and the direction from which the sound is arriving. Another mechanism is the brain's integration of the occlusion information described above with the motion of the listener's head. Yet another mechanism is the brain's integration of information from early acoustic reflections within an environment to detect the direction and distance of the audio source. Therefore, in some cases, it may provide a more natural listening experience to reproduce audio for a listener such that he can accurately perceive his location and orientation (e.g., head orientation) relative to the audio source. Referring back to FIG. 1A, it can thus be valuable to maintain the spatial cues contained within the transfer functions $H_L$ (112) and $H_R$ (114) when reproducing audio from the remote audio source 102 for the listener 106.

In some implementations, microphones $M_L$ (108) and $M_R$ (110), are positioned farther away from the audio source 102 than the microphone array 104 is. For example, microphones $M_L$ (108) and $M_R$ (110) may be positioned at a substantial distance from the remote audio source 102 while microphone array $M_P$ is positioned at or near the location of the audio source 102. Consequently, the signals captured by microphones $M_L$ (108) and $M_R$ (110) may have lower SNR than the signal captured by microphone array 104 due to the presence of noise in the environment 100A. In such cases, if the listener 106 were to listen to the signals captured by microphones $M_L$ (108) and $M_R$ (110), she would hear the spatial cues indicative of her location relative to the audio source 102; however, she may perceive the audio to be of low quality. In contrast, if the listener 106 were to listen to the signals captured by microphone array $M_P$ (104), she may perceive the audio to be of higher quality (e.g., higher SNR); however, she would not have perception of her true location relative to the audio source 102. In some cases, the SNR of the signals captured by microphone array $M_P$ (104) can be further increased using beamforming or SNR-enhancing techniques.

To address this issue, it may be desirable in some cases to take the audio recorded by microphone array $M_P$ (104) and play it back to the listener 106 as though it arrived by the pathways characterized by transfer functions $H_L$ (112) and $H_R$ (114). The resulting audio may be perceived by the listener 106 to be of high quality while maintaining spatial information about the position of the listener 106 relative to the remote audio source 102. In some implementations, $M_P$ (104) may not be necessary at all to capture the input signal representative of audio from the remote audio source 102. For example, if the remote audio source 102 is a speaker device, a source signal such as a driver signal to the speaker device may be captured directly from the remote audio source 102 and used instead. Various techniques to enhance remotely generated audio in this manner are further described herein.

Figure 1B:
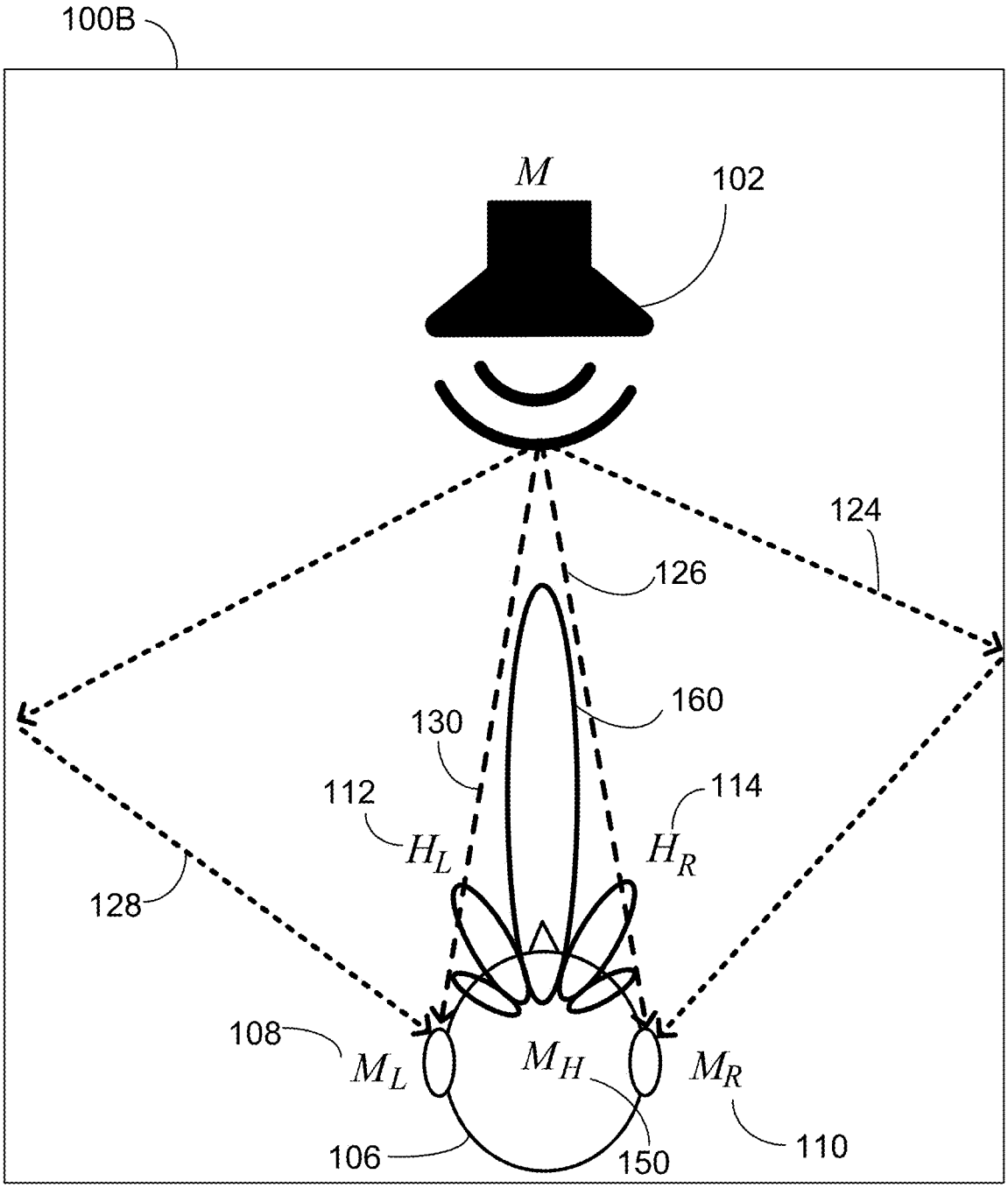

FIG. 1B shows a second example environment 100B including the remote audio source 102 and the listener 106. In contrast to the first example environment 100A, environment 100B does not include a microphone array $M_P$ (104) for capturing a high quality (e.g., high SNR) signal of the audio from the remote audio source 102. Rather, in this example, an on-head microphone array $M_H$ (150) captures signals from the remote audio source 102 in order to generate a high-SNR signal. The on-head microphone array $M_H$ (150) includes a plurality of microphones disposed on a head-worn device, which may or may not include ear microphones $M_L$ (108) and $M_R$ (110). The signals captured by the on-head microphone array $M_H$ (150) can be combined to create an estimate of the original audio from the remote audio source 102. In some cases, the estimate of the original audio can be of higher quality (e.g., have higher SNR) than the audio captured by ear microphones $M_L$ (108) and $M_R$ (110). For example, using beamforming and/or one or more other SNR-enhancing techniques, an estimate of the original audio can be derived from the signals captured by the on-head microphone array $M_H$ (150), the estimate of the original audio having higher SNR than the audio captured by ear microphones $M_L$ (108) and $M_R$ (110).

An example beamforming pattern 160 can be implemented from the signals captured by on-head microphone array $M_H$ (150) and the beamforming process can be configured to enhance signals arriving from the direction of the remote audio source (e.g., straight ahead of the user). The resulting estimate of the original audio may have higher SNR than the audio signals captured by ear microphones $M_L$ (108) and $M_R$ (110) due to its large response to direct arrivals 126,130 of sound from the audio source 102. However, the beamforming pattern 160 has relatively small response to the indirect arrivals 124,128 of sound from the audio source 102, and therefore an amplitude that varies very differently from the ear microphones $M_L$ (108) and $M_R$ (110) as the listener 106 moves his head. Consequently, the high-SNR estimate of the original audio does not have the spatial characteristics of audio captured at the listener's ears and may be perceived as unnatural to the listener (106) in terms of spatial perception. In some cases, the on-head microphone array $M_H$ (150) can produce a stereo signal, as in the case of a binaural minimum variance distortional response (BMVDR) beamformer, but in some cases, this may compromise beam performance for binaural performance. While beamforming pattern 160 is provided as an example beamforming pattern, beamforming patterns of all shapes and forms may be implemented.

The technology described herein addresses the foregoing issues by further enhancing the high-SNR audio derived from signals captured by the on-head microphone array $M_H$ (150) by combining the high-SNR audio with signals captured by the ear microphones $M_L$ (108) and $M_R$ (110) to generate audio that is perceived by the listener 106 as arriving via the pathways characterized by transfer functions $H_L$ (112) and $H_R$ (114). Various techniques to enhance remotely generated audio in this manner are further described herein. In general, while these techniques may be described herein as implemented using a signal captured by the off-head microphone array $M_P$ (104) of FIG. 1A, any of these techniques may also be implemented using a high-SNR estimate of the original audio derived from signals captured by the on-head microphone array $M_H$ (150) of FIG. 1B.

Figure 2:
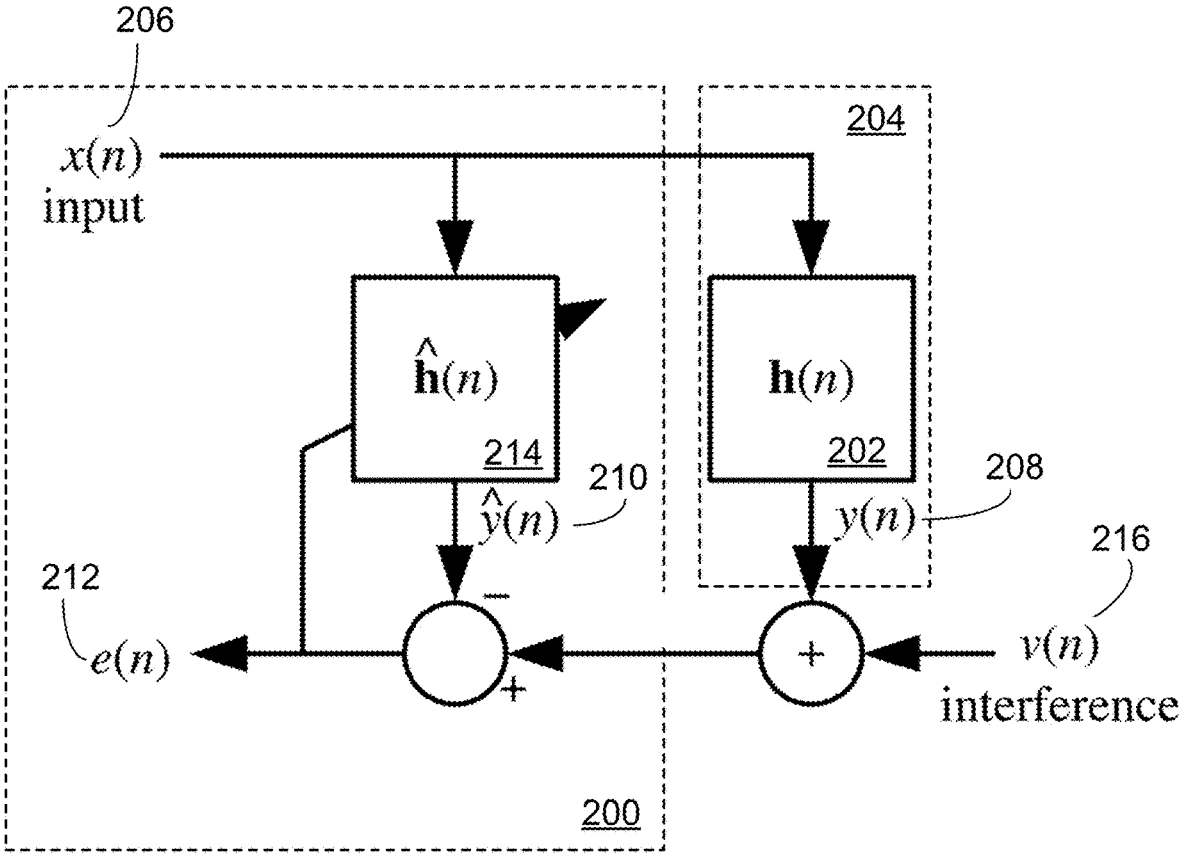
FIG. 2 is a block diagram showing an example of an adaptive filter system that estimates the transfer function of an unknown system.

A first technique for enhancing audio from remote audio sources includes the use of adaptive filter systems. FIG. 2 shows an adaptive filter system 200 that estimates the true transfer function, h(n) (202), of an unknown system 204. The unknown system 204 takes an input signal, x(n) (206), and outputs an output signal, y(n) (208). The adaptive filter system 200 takes the same input signal 206, and outputs an estimated output signal $\hat{y}(n)$ (210), which approximates the output signal 208. At each step of operation, adaptive filter system 200 attempts to reduce (e.g., minimize) the error, e(n) (212) between the true output signal 208 and the estimated output signal 210 to update the estimated transfer function, $\hat{h}(n)$ (214). Over time, the estimated transfer function 214 (sometimes referred to as a filter function 214) may converge to become a closer and closer estimate of the true transfer function 202. In some cases, interference, v(n) (216) may also be present, polluting the true output signal 208 such that the measured error 212 is not a direct difference between output signal 208 and estimated output signal 210.

Referring back to the environment 100A of FIG. 1A, in order to enhance audio from remote audio source 102, the audio collected at the microphone array $M_P$ (104) can be used as the input signal 206 to adaptive filter system 200, and the signals captured by microphones $M_L$ (108) and $M_R$ (110) may each be treated as the output signal 208 to be approximated, for example, by two distinct adaptive filter systems. In the context of environment 100B of FIG. 1B, in order to enhance audio from remote audio source 102, the beamformed estimate of the original audio can be used as the input signal 206 to adaptive filter system 200, and the signals captured by microphones $M_L$ (108) and $M_R$ (110) may each be treated as the output signal 208 to be approximated, for example, by two distinct adaptive filter systems. In this case, the filter function 214 of each adaptive filter system 200 would adapt over time such that the high SNR audio signal collected by microphone array $M_P$ (104) would be processed to sound to a listener (e.g., listener 106) as though it arrived by the pathways characterized by transfer functions $H_L$ (112) and $H_R$ (114) respectively. In other words, the estimated transfer function 214 would converge to a filter function 214 that inverts the path to the microphone array $M_P$ (104) and adds in the paths to microphones $M_L$ (108) and $M_R$ (110) respectively. That is, for the left ear of the listener 106, an ideal filter would converge such that the estimated transfer function 214 approaches $H_L/H_P$. Analogously, for the right ear of the listener 106, an ideal filter would converge such that the estimated transfer function 214 approaches $H_R/H_P$.

It is noted that the challenge of audio enhancement for remote audio sources is a dynamic problem because each of the acoustic paths (e.g., the acoustic paths characterized by transfer functions 112,114, 116) can change with any movement of the listener 106, the audio source 102, or the microphone array 104. However, in the technique described above, the adaptive filter system 200 is able to automatically account for such changes without the need for any additional sensors or user input. Moreover, the technique described above has the advantage that, if the correlation between the on-head microphones 108, 110 and the off-head microphone 104 were to fall apart (e.g., because the off-head microphone 104 was moved far away from the listener 106), the adaptive filter system 200 would fall back to matching the energy distribution of the off-head microphone 104 to that of the on-head microphones 108, 110. Consequently, if the listener 106 is in an environment 100A,100B with roughly speech or white-shaped noise present, the adaptive filter system 200 would pass the signal captured by the off-head microphone 104 (i.e., input signal 206) largely unchanged. That is, the system could always be biased to effectively revert to an all-pass filter in the case where on-head microphones 108, 110 do not receive any energy from the remote audio source 102. In some cases, this may be modified depending on the use condition of the audio enhancement system described herein.

Figure 3A:
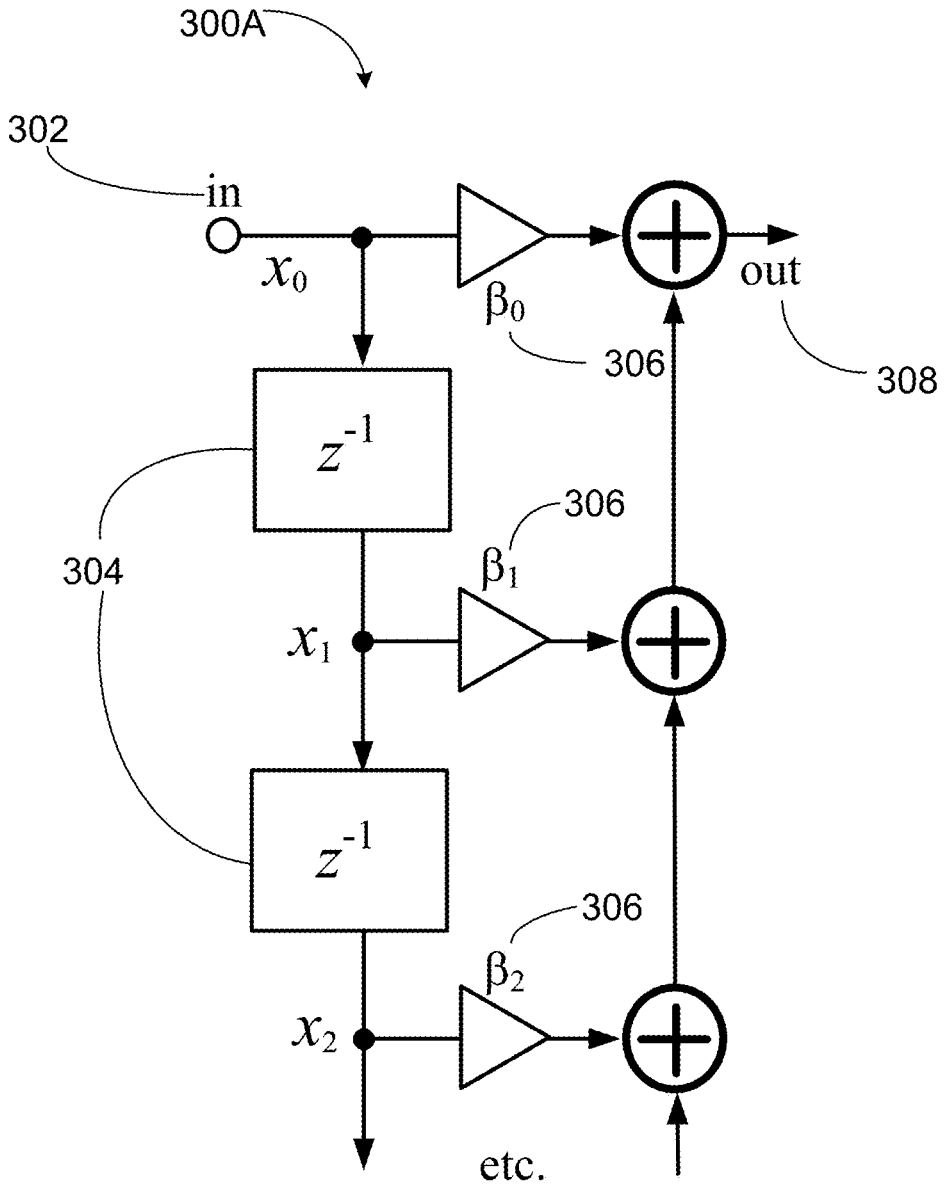
FIG. 3A is a block diagram of an example of a finite impulse response (FIR) filter.

In different implementations, various filters and optimization algorithms to minimize error may be used within the adaptive filter system 200, resulting in different performance characteristics. FIG. 3A shows an example standard finite impulse response (FIR) filter 300A, sometimes referred to as a "tapped delay line". An input signal 302 is received by the FIR filter 300A, and is passed through a series of delay elements, $z^{-1}$ (304). The original input signal 302 and the output of each delay element 304 are each multiplied by a corresponding filter coefficient 306 of the FIR filter 300A, and the results are summed to generate an output signal 308. In some cases, the values of the filter coefficients 306 may correspond to a particular filter function (e.g., filter function 214). For example, when the FIR filter 300A is implemented within the adaptive filter system 200, the filter coefficients 306 may be updated to minimize the error 212 in accordance with a particular optimization algorithm.

In practice, a least-mean squares (LMS) optimization algorithm is a simple and robust approach that performs well for this scenario. The adaptation rate of the FIR filter 300A can be selected to balance reducing background noise (which tends to vary on different time scales than the discrete sound sources that are enhanced) and making sure the filter 300A tracks well with the listener's head motion so that the adaptation behavior is well-tolerated. In some cases, the listener 106 may notice some slight delay if he is really trying to detect it, but the use of an LMS adaptive filter system 200 does not otherwise interfere with the audio experience. While the filters are described herein to be adapted using an LMS optimization algorithm, other implementations may include the use of any appropriate optimization algorithm, many of which are well-known in the art.

In some implementations, the direct application of a LMS optimization algorithm with the standard FIR filter 300A can cause the filter to overemphasize some frequencies over others. For example, the standard FIR filter 300A has equal filter resolution across the whole spectrum and oftentimes adapts more quickly to low frequency sounds than high frequency sounds because of the distribution of energy in human speech. The resulting audio can have an objectionable, slightly "underwater" sounding effect.

Figure 3B:
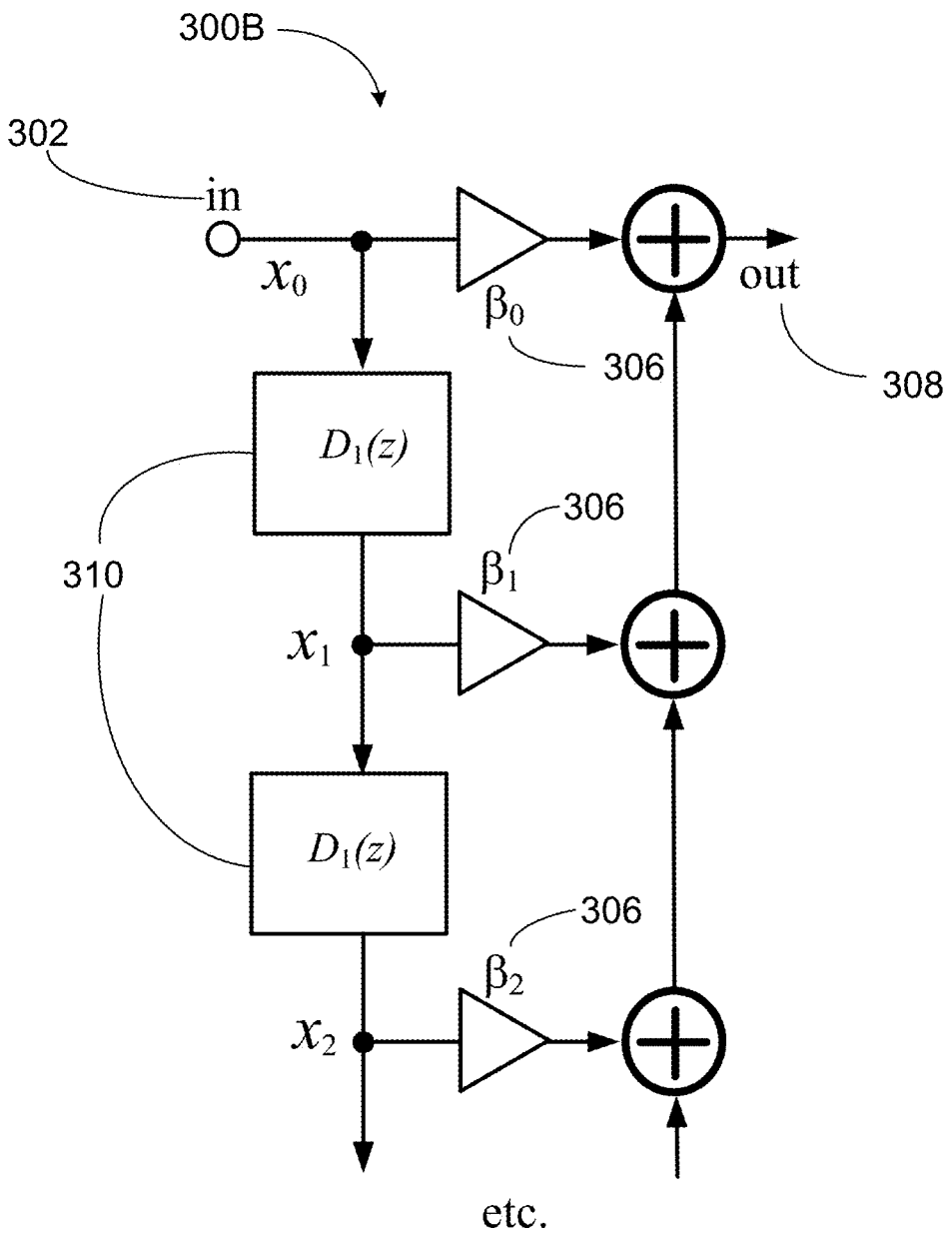
FIG. 3B is a block diagram showing an example of a warped FIR filter that can be used in some implementations of the technology described herein.

In some implementations, a warped FIR filter may be used instead of the standard FIR filter 300A within adaptive filter system 200 to mitigate this problem. For example, a warped FIR filter may distribute the filter energy in a more logarithmic fashion, placing more resolution at lower frequencies than higher frequencies, which corresponds to the way humans perceive different frequencies. FIG. 3B shows an example warped FIR filter 300B. The warped FIR filter 300B replaces the delay elements 304 of the standard FIR filter 300A with first order all-pass filters 310, effectively warping the frequency axis. The input signal 302 is received by the warped FIR filter 300B, and is passed through a series of first order all-pass filters, $D_1(z)$ (310). The original input signal 302 and the output of each all-pass filter 310 are each multiplied by a corresponding filter coefficient 306 of the warped FIR filter 300B, and the results are summed to generate an output signal 308. In some cases, the values of the filter coefficients 306 may correspond to a particular filter function (e.g., filter function 214). For example, when the warped FIR filter 300B is implemented within the adaptive filter system 200, the filter coefficients 306 may be updated to minimize the error 212 in accordance with a particular optimization algorithm such as an LMS optimization algorithm.

Figure 4:
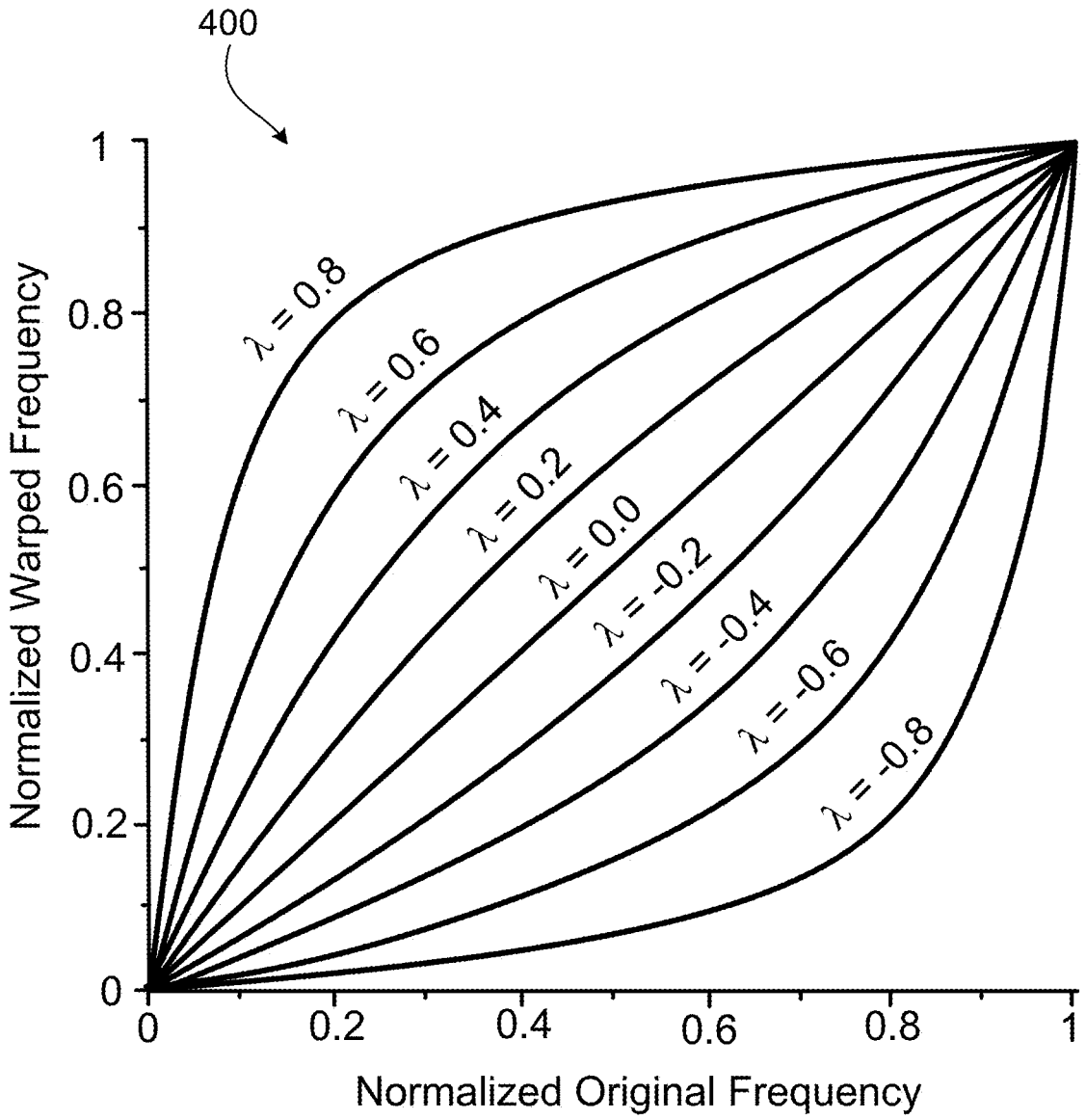
FIG. 4 is a graph showing the relationship between the normalized frequency axes of the FIR filter of FIG. 3A and the warped FIR filter of FIG. 3B.

In some implementations, the all-pass filter 310 may be expressed as $$D_1(z) = \frac{z^{-1} + \lambda}{1 + \lambda z^{-1}},$$

where the parameter λ controls the degree of warping of the frequency axis. FIG. 4 is a graph 400 showing the relationship between the normalized frequency axes of the standard FIR filter 300A of FIG. 3A and the warped FIR filter 300B of FIG. 3B. When λ=0, the warped FIR filter 300B behaves identically to the standard FIR filter 300A. However, as λ approaches 1, the frequency axis becomes more and more warped, such that the warped FIR filter 300B provides higher resolution at lower frequencies and lower resolution at higher frequencies. Conversely, as λ approaches −1, the frequency axis becomes more and more warped, such that the warped FIR filter 300B provides lower resolution at lower frequencies and higher resolution at higher frequencies.

Figure 5:
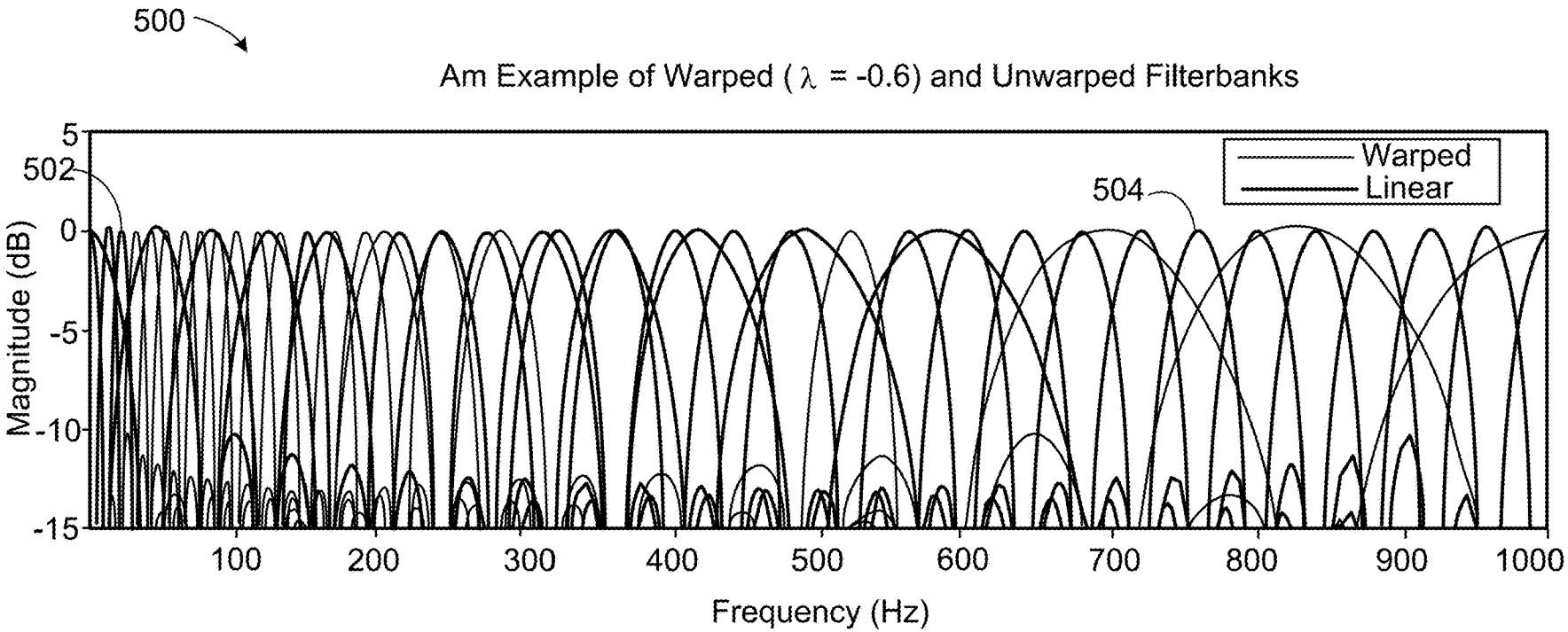
FIG. 5 is a graph showing an example comparison of the frequency resolutions of the standard FIR filter of FIG. 3A and the warped FIR filter of FIG. 3B.

FIG. 5 is a graph 500 showing a comparison of the frequency resolutions of the standard FIR filter 300A of FIG. 3A and the warped FIR filter 300B of FIG. 3B, using the example of λ=0.6. Line 502 corresponds to the warped FIR filter 300B, and line 504 corresponds to the standard (also referred to as linear) FIR filter 300A. While the standard FIR filter 300A provides equal resolution across all frequencies, the warped FIR filter 300B with λ=0.6 provides higher resolution at low frequencies and lower resolution at high frequencies. In some cases, the warped FIR filter 300B may yield a more natural audio experience than the standard FIR filter 300A because the spectral resolution of the human auditory system more closely matches the warped filter 300B. In some cases, when the frequency range of interest of the adaptive filter system 200 is below a threshold frequency (e.g., 250 Hz), the warped FIR filter 300B may have the advantage of achieving the same spectral resolution as the standard FIR filter 300A using fewer filter coefficients 306. In other cases, the number of filter coefficients 306 of the warped FIR filter 300B and the standard FIR filter 300A can be the same; however, the warped FIR filter provides higher spectral resolution in the low frequencies, resulting in better performance without requiring significant excess computation.

Figure 6:
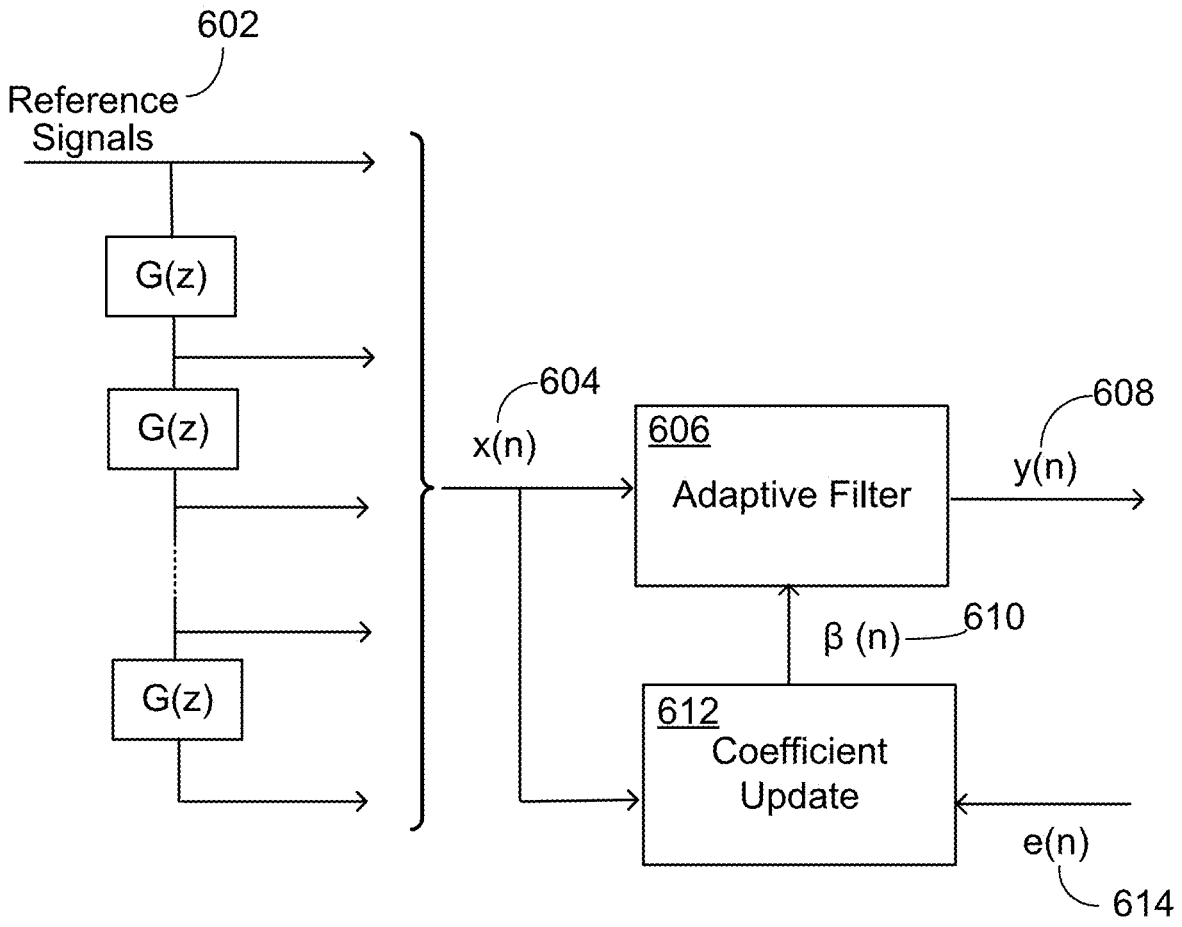
FIG. 6 is a block diagram showing an example implementation of a filter within an adaptive filter system.

FIG. 6 demonstrates how various adaptive filters (e.g. standard FIR filter 300A or warped FIR filter 300B) can be implemented within an adaptive filter system (e.g. adaptive filter system 200). Reference signals 602 are buffered into an input signal, represented by input vector x(n), 604. The input vector 604 is then used to compute the output signal 608 of the adaptive filter 606, by taking the dot product of the input vector 604 with the filter coefficient vector, β(n) (610). This can be expressed mathematically as:

$$y(n)=x(n)^T\cdot\beta(n)$$

The input vector 604 is also used to compute the update 612 to the current filter coefficients 610, generating updated filter coefficients, β(n+1). Generally, the update equation is a function of the error signal, e(n) (614); the current filter coefficients, β(n) (610); the input vector x(n), 604; and a step-size parameter, μ. As an example, the coefficient update 612 may be expressed mathematically as $$\beta(n+1) = \beta(n) + \mu \cdot e(n)\frac{x(n)}{\|x(n)\|_2^2}$$

In some cases, different adaptive filters can be implemented by adjusting the buffering of the reference signals 602 into the input vector 604. For example, the standard FIR filter 300A of FIG. 3A can be implemented by using $G(z)=z^{-1}$ so that the input vector 604 is comprised of delayed samples of the reference signals 602. On the other hand, the warped FIR filter 300B of FIG. 3B can be implemented by using $$G(z) = \frac{z^{-1} + \lambda}{1 + \lambda z^{-1}},$$

replacing the delays of the standard FIR filter 300A with first order all-pass filters. In some cases, the parameters μ and λ may be adjusted for desired performance.

The better balance in the frequency domain of the warped FIR filter 300B results in better noise reduction, and the longer delay created by the all-pass filters has the additional effect of representing more delay with fewer filter taps. This is advantageous for the enhancement of audio originating from remote audio sources because reflected sound from the remote audio source can take much longer to arrive at the microphones than the direct arrivals. The more of those reflections (i.e. indirect arrivals) that are captured by the filter, the more robust the sense of space produced by the audio enhancement system.

Referring back to FIG. 1A, in some cases, the environment 100A may contain multiple audio sources 102 generating sound simultaneously. In such cases, a single off-head microphone array (e.g., microphone array 104) may enable the generation of some statistical average between the optimal filter functions for each remote audio source 102 based on the energies arriving at the off-head microphone 104 from each source 102. However, in some implementations, multiple off-head microphone arrays 104 may be used. For example, a separate off-head microphone signal can be captured for every separate remote audio source 102 within the environment 100A. In some implementations, a microphone array (e.g., an on-head microphone array), may use beamforming to implement multiple beams, each beam corresponding to one of the multiple remote audio sources 102 within the environment 100A. In some cases, these implementations may be referred to as multiple-input, single output (MISO) systems, wherein the multiple inputs correspond to the multiple audio sources, and wherein a single output is generated for each ear of the listener 106.

Compared to the previously described examples with a single remote audio source 102, the mathematics of the filter coefficient update can be revised such that multiple filters are concatenated together as though they were one, larger LMS adaptive filter system normalized by the energy present in each of the multiple remote audio sources 102. In particular, for each of the multiple off-head microphones, k, the vector of filter coefficients $\beta_k$ can be calculated using the error e and the warped filter samples $x_k$ as:

For n=0, 1, 2, . . .

For k=1, . . . , N:

$$e(n)=d(n)-\Sigma_k\beta_k(n)^T x_k(n)$$

$$\beta_k(n+1)=\beta_k(n)+\mu e x_k(n)/(x_k(n)^T x_k(n)+\epsilon)$$

where d(t) represents the on-head microphone samples and $\mu$ is the step-size parameter (i.e., adaptation rate) of the filter. This is reduced to the setting of a single remote audio source 102 when N=1.

While the adaptive filter systems described above operate in the time domain, in some implementations, frequency domain adaptive filter systems may also be used in combination or instead of the adaptive filter systems described in the preceding examples.

A second technique for enhancing audio from remote audio sources includes the use of angle-of-arrival (AoA) estimation techniques. In some implementations, AoA estimation techniques may be used to estimate the AoA of an incoming audio signal from the remote audio source 102 to the on-head microphones $M_L$ (108) and $M_R$ (110). Various AoA estimation techniques are well-known in the art, and in general, any appropriate AoA estimation technique may be implemented. AoA estimation techniques can approximate the azimuth and elevation of the remote audio source 102 and/or the off-head microphone array $M_P$ (104). Using this spatial information about the location of the remote audio source 102 relative to the listener 106, appropriate head-related transfer functions associated with the estimated AoA can be applied in real time to make the audio reproduced to the listener 106 appear to originate from the true direction of the remote audio source 102. In some implementations, the appropriate head-related transfer functions for a particular AoA (e.g, for the left ear and right ear of the listener 106) can be selected from a look-up table. Compared to techniques involving adaptive filter systems, the use of a look-up table with AoA estimation may yield faster response times to changes in the location and head orientation of the listener 106 relative to the remote audio source 102.

In some implementations, the AoA estimation technique may focus on only a portion of the signals captured by the on-head microphones $M_L$ (108) and $M_R$ (110). For example, AoA estimation techniques may only be implemented on the time or frequency frames of the captured signals that correlate to the signal captured by the off-head microphone array $M_P$ (104). In some implementations, a correlation value between the signals captured by on-head microphone 108, 110 and off-head microphone array 104 may be tracked, and AoA estimation performed only when the correlation value exceeds a threshold value. This may provide the advantage of reducing the audio enhancement system's computational load in situations where the listener 106 is located very far from the remote audio source 102. Moreover, in some cases, when the correlation value does not exceed the threshold value, the audio enhancement system can be configured to pass on to the listener 106 the audio captured by the off-head microphone 104, leaving it substantially unchanged. In some cases, rather than using a signal captured by the off-head microphone array $M_P$ (104), a high-SNR estimate of the original audio derived from signals captured by an on-head microphone array $M_H$ (150) may be used.

A third technique for enhancing audio from remote audio sources includes the use of spectral mask-based techniques. For example, referring back to FIG. 1A, the signal captured by off-head microphone array 104 can be used to create a spectral mask to enhance speech or music and suppress noise in the signals captured by the on-head microphones 108, 110. If the phase of the signal is unaffected, and the same spectral mask is used for both the left and right ears of listener 106, then the spatial cues present in the signals captured by the on-head microphones 108, 110 (e.g., binaural cues) should stay intact. The result would be an audio signal that maintains the spatial information of the signals captured by the on-head microphones 108, 110, but with a higher SNR. In some cases, rather than using a signal captured by the off-head microphone array 104, a high-SNR estimate of the original audio derived from signals captured by an on-head microphone array $M_H$ (150) may be used.

Figure 7:
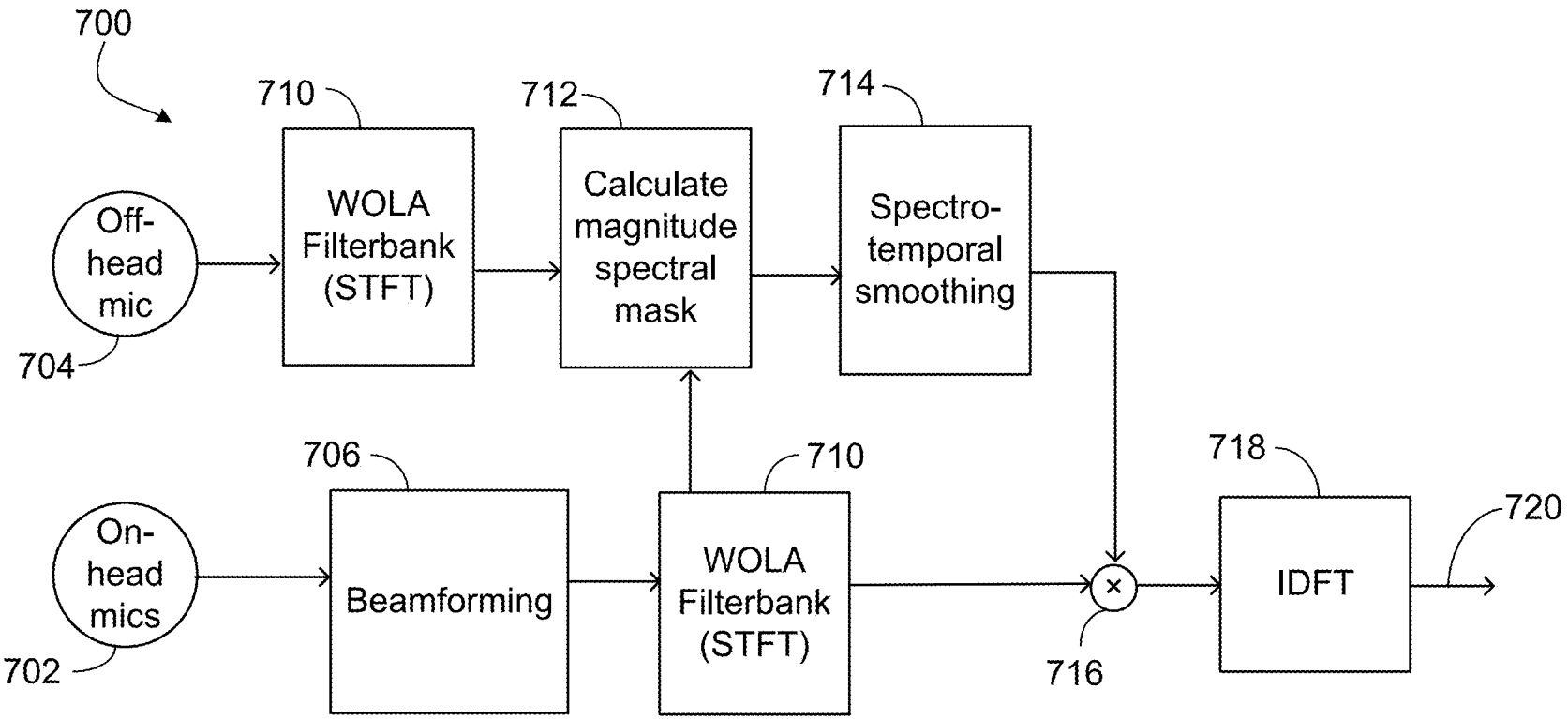
FIG. 7 is a block diagram showing an example spectral mask-based technique for enhancing audio from remote audio sources in accordance with the technology described herein.

FIG. 7 shows an example of a spectral mask-based system 700 for enhancing audio from remote audio sources (e.g., remote audio source 102). On-head microphones 702 capture signals representative of audio from a remote audio source and the captured signals are beamformed (806) to generate a signal with spatial information indicative of the listener's location relative to the remote audio source. Beamforming can be performed binaurally or bilaterally, depending on the capabilities of the on-head device. For example, the left side of the on-head device may have a front microphone and a rear microphone. Using a delay-and-summing beamforming technique on the signals captured from the front microphone and rear microphone, a signal with spatial information can be generated corresponding to audio heard by the left ear of the listener. Similarly, an analogous signal can be generated corresponding to audio heard by the right ear of the listener. While the beamformer 706 is described as implemented using a delay-and-summing technique, various beamforming techniques are known in the art, and any appropriate beamforming technique may be used.

Simultaneously to the signal capture of the on-head microphones 702, an off-head microphone 704 collects a signal representative of audio from the same remote audio source. In some implementations, the off-head microphone 704 is positioned closer to the remote audio source than the on-head microphones 702. Consequently, the signal captured by the off-head microphone 704 may have a higher SNR that the signals captured by the on-head microphones 702. In some implementations, the off-head microphone 704 can be a single, monoaural microphone. In some cases, rather than using a signal captured by the off-head microphone array 704, a high-SNR estimate of the original audio derived from signals captured by an on-head microphone array $M_H$ (150) may be used.

The time domain signal captured by the off-head microphone 704 and the beamformed time domain signal derived from the on-head microphones 702 are each transformed into the frequency domain. In some implementations, this can be accomplished with a Window Overlap and Add (WOLA) technique 710. However, in some implementations other appropriate transformation techniques may be used such as Discrete Short Time Fourier Transforms.

Once the time domain signals have been converted into the frequency domain, we can calculate a magnitude spectral mask (812) based on the on-head and off-head frequency domain signals. In some cases, the spectral mask can be configured to enhance speech or music and suppress noise in the signals captured by the on-head microphones 702. Various spectral masks can be used for this task. For example, if s is a complex vector representing a spectrogram of one frame of the off-head frequency domain signal, y is a complex vector representing a spectrogram of one frame of the on-head frequency domain signal, and $\tau$ is a threshold or quality factor, then a threshold mask can be defined as $$|s| \text{ if } |s|>\tau; \text{ else } 0.$$

A binary mask can be defined as $$1 \text{ if } |y|>|y-s|; \text{ else } 0.$$

An alternative binary mask can be defined as $$1 \text{ if } 10\log_{10}\left(\frac{|s|}{|y|}\right) > \tau; \text{ else } 0$$

A ratio mask can be defined as $$|s|^{\tau}/|y|^{\tau}.$$

A phase-sensitive mask can be defined as $$\frac{|s|}{|y|}\cos(\angle s - \angle y).$$

Figure 8:
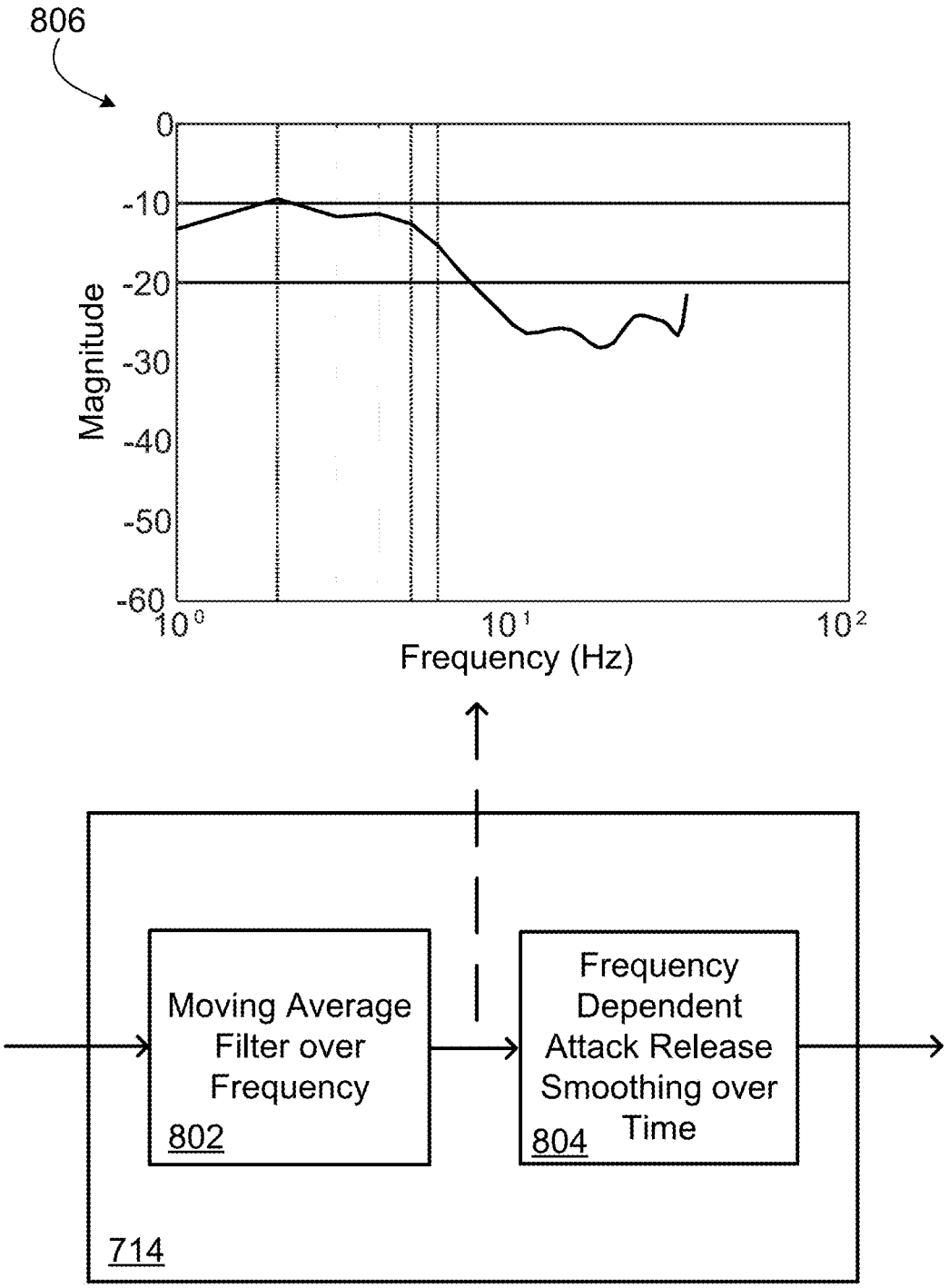
FIG. 8 is a block diagram showing an example spectro-temporal smoothing process.

Subsequent to calculating the magnitude spectral mask (812), modulation artifacts are reduced through spectro-temporal smoothing 714. In some cases, spectro-temporal smoothing 714 may help to "link" together (e.g., remove discontinuities) in the magnitude response across multiple frequency bins as well as smooth out any peaks and valleys in the magnitude response. An example spectro-temporal smoothing system 714 is shown in FIG. 8. In some implementations, spectro-temporal smoothing system 714 can include a moving average filter over frequency 802, resulting in smoothed relationship between frequency and magnitude as shown in graph 806. In addition to smoothing in the frequency domain, spectro-temporal smoothing system can further include an smoothing engine 804 for frequency dependent attack release smoothing over time. For example, a one-pole low-pass filter with switchable attack and release times may be implemented to smooth the magnitude response over consecutive time frames.

Referring again to FIG. 7, the output of spectro-temporal smoothing process 714 is an approximate smoothed magnitude response of the audio from the remote audio source. This output can be multiplied (716) by the on-head frequency domain signal (e.g., using pointwise multiplication) to perform time-frequency masking. An inverse discrete Fourier transform (IDFT) 718 of the resulting product can then be taken to generate an output signal 720. In general, any appropriate method for transforming signals from the frequency domain to the time domain may be implemented. Using the spectral mask-based audio enhancement system 700, the output signal 720 maintains the spatial information derived from the signals captured by the on-head microphones 702 while having enhanced SNR due to the spectral mask derived from the signal captured by the off-head microphone 704.

Figure 9:
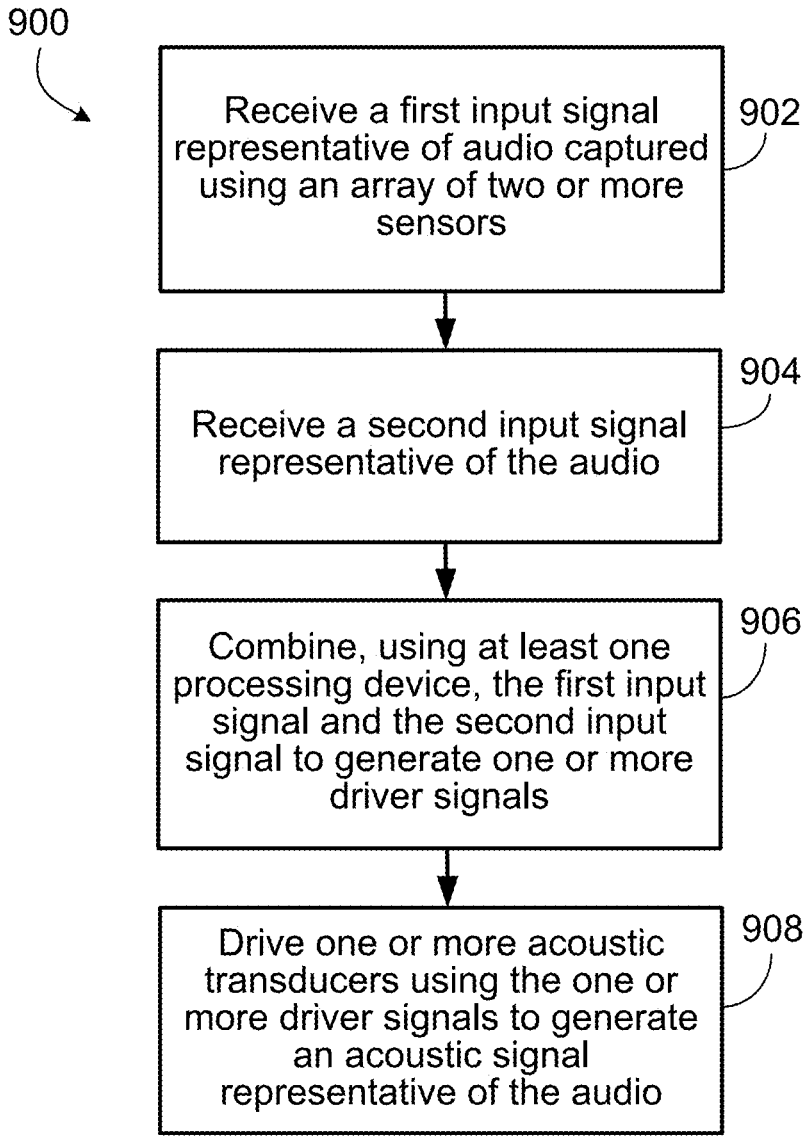
FIG. 9 is a flow chart of a first example process for audio enhancement.

FIG. 9 shows a flowchart of an example process 900 for audio enhancement. Operations of the process 900 include receiving a first input signal representative of audio captured using an array of two or more sensors (902). In some implementations, the first input signal can be characterized by a first signal-to-noise ratio (SNR) and the audio can be a signal of interest. For example, the two or more sensors may correspond to on-head microphones $M_L$ (108) and $M_R$ (110) described in relation to FIGS. 1A-1B, and the audio can correspond to audio generated from the remote audio source 102. In some cases, the first input signal can include a plurality of input signals (e.g., an input signal captured by $M_L$ and an input signal captured by $M_R$).

The operations also include receiving a second input signal representative of the audio (904). The second input signal can be characterized by a second SNR that is higher than the first SNR, and the audio can be the signal-of-interest. Moreover, the second input signal can originate at a first location that is remote with respect to the array of two or more sensors. In some implementations, the second input signal can be a source signal for the audio generated at the first location (e.g., a driver signal for remote audio source 102). In some implementations, the second input signal can be captured by a sensor disposed at a second location, the second location being closer to the first location as compared to the array of two or more sensors. For example, the sensor disposed at the second location can correspond to microphone array $M_P$ (104), and the second input signal can correspond to the signal captured by the off-head microphone array $M_P$ (104). In some implementations, the second input signal can be derived from signals captured by a microphone array disposed on a head-worn device. For example, the second input signal can correspond to the high-SNR estimate of the original audio derived from signals captured by the on-head microphone array $M_H$ (150). In some implementations, the microphone array disposed on a head-worn device may include the array of two or more sensors. In some implementations, the second input signal can be derived from the signals captured by the microphone array using beamforming, SNR-enhancing techniques, or both.

The operations of the process 900 further include combining, using at least one processing device, the first input signal and the second input signal to generate one or more driver signals (906). The driver signals can include spatial information derived from the first signal, and can be characterized by a third SNR that is higher than the first SNR. In some implementations, generating the one or more driver signals includes modifying the second input signal based on the spatial information derived from the first input signal, and in some implementations, generating the one or more driver signals includes modifying the first input signal based on the second input signal.

In some implementations, deriving the spatial information from the first signal includes estimating a transfer function that characterizes, at least in part, acoustic paths from the first location to the two or more sensors, respectively. For example, estimating the transfer function may correspond to estimating $H_L$, $H_R$, $H_L/H_P$, or $H_R/H_P$ using adaptive filter system 200 described in relation to FIG. 2. Furthermore, estimating the transfer function can include updating coefficients of an adaptive filter, (e.g., using an LMS optimization algorithm). In some implementations, the adaptive filter can include an all-pass filter disposed between two adjacent taps of the adaptive filter, and in some implementations, the adaptive filter can provide greater frequency resolution at lower frequencies that at higher frequencies. For example, the adaptive filter may correspond to the warped FIR filter 300B described in relation to FIG. 3B.

In some implementations, operations of the process 900 may further include receiving a third input signal representative of the audio, the third input signal originating at a third location that is remote with respect to the array of two or more sensors, and processing the third input signal with the first input signal and the second input signal to generate the one or more driver signals. For example, the third input signal originating at the third location may correspond to audio originating at a second remote audio source 102 in the MISO case described above. In some implementations, deriving the spatial information from the first input signal can include estimating a first transfer function based on (i) a second transfer function that characterizes acoustic paths from the second location to the array of two or more sensors, and (ii) a third transfer function that characterizes acoustic paths from the third location to the array of two or more sensors. In some implementations, the first transfer function can be estimated using a first adaptive filter and a second adaptive filter, the first adaptive filter and the second adaptive filter associated with the estimates of the second transfer function and the third transfer function respectively.

In some implementations, deriving the spatial information from the first signal includes estimating an angle of arrival of the first signal to the two or more sensors. For example, deriving the spatial information from the first signal can correspond to implementing the AoA estimation techniques described above for approximating the azimuth and elevation of the remote audio source 102 relative to the microphones $M_L$ (108) and $M_R$ (110) of FIGS. 1A-1B.

The operations of the process 1000 also include driving one or more acoustic transducers using the one or more driver signals to generate an acoustic signal representative of the audio (908). For example, in some implementations, the acoustic transducers may be speakers disposed on an on-head device worn by a user (e.g., listener 106 of FIGS. 1A-1B).

Figure 10:
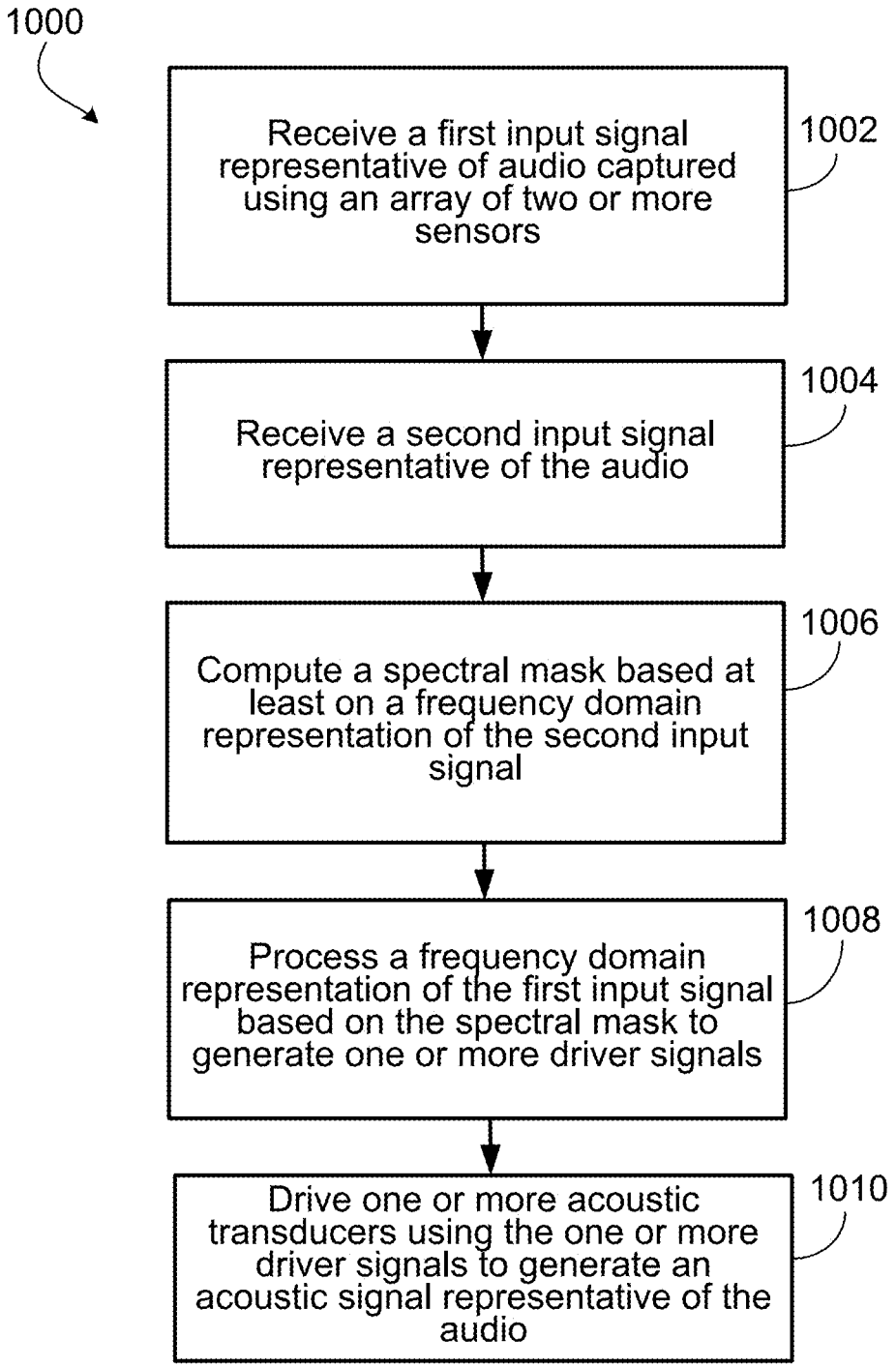
FIG. 10 is a flow chart of a second example process for audio enhancement.

FIG. 10 shows a flowchart of a second example process 1000 for audio enhancement. Operations of the process 1000 include receiving a first input signal representative of audio captured using an array of two or more sensors (1002). In some implementations, the first input signal can be characterized by a first signal-to-noise ratio (SNR) and the audio can be a signal of interest. For example, the two or more sensors may correspond to on-head microphones $M_L$ (108) and $M_R$ (110) described in relation to FIG. 1A, and the audio can correspond to audio generated from the remote audio source 102. In some cases, the first input signal can include a plurality of input signals (e.g., an input signal captured by $M_L$ and an input signal captured by $M_R$).

The operations also include receiving a second input signal representative of the audio (1004). The second input signal can be characterized by a second SNR that is higher than the first SNR, and the audio can be the signal-of-interest. Moreover, the second input signal can originate at a first location that is remote with respect to the array of two or more sensors. In some implementations, the second input signal can be a source signal for the audio generated at the first location (e.g., a driver signal for remote audio source 102). In some implementations, the second input signal can be captured by a sensor disposed at a second location, the second location being closer to the first location as compared to the array or two or more sensors. For example, the sensor disposed at the second location can correspond to microphone array $M_P$ (104), and the second input signal can correspond to the signal captured by the off-head microphone array $M_P$ (104). In some implementations, the second input signal can be derived from signals captured by a microphone array disposed on a head-worn device. For example, the second input signal can correspond to the high-SNR estimate of the original audio derived from signals captured by the on-head microphone array $M_H$ (150). In some implementations, the microphone array disposed on a head-worn device may include the array of two or more sensors. In some implementations, the second input signal can be derived from the signals captured by the microphone array using beamforming, SNR-enhancing techniques, or both.

The operations of the process 1000 further include computing a spectral mask based at least on a frequency domain representation of the second input signal (1006). In some implementations, the frequency domain representation of the second input signal can be obtained using a Window Overlap and Add (WOLA) technique or Discrete Short Time Fourier Transform. Furthermore, in some implementations, the frequency domain representation of the second input signal comprises a first complex vector representing a spectrogram of a frame of the second input signal.

In some implementations, computing the spectral mask can include determining whether a magnitude of the first complex vector satisfies a threshold condition, and in response, setting the value of the spectral mask to the magnitude of the first complex vector, and in response, setting the value of the spectral mask to zero. For example, the spectral mask may correspond to the threshold mask described in relation to FIG. 7.

In some implementations, the frequency domain representation of the first input signal comprises a second complex vector representing a spectrogram of a frame of the first input signal. In such implementations, computing the spectral mask can include determining whether a magnitude of the second complex vector is larger than a magnitude of a difference between the first and second complex vectors, and in response, setting the value of the spectral mask to unity, and in response, setting the value of the spectral mask to zero. For example, the spectral mask may correspond to the binary mask described in relation to FIG. 7.

In some implementations, computing the spectral mask can include setting the value of the spectral mask to a value computed as a function of a ratio between (i) the magnitude of the first complex vector, and (ii) magnitude of the second complex vector. Moreover, in some implementations, computing the spectral mask can include setting the value of the spectral mask to a value computed as a function of difference between (i) a phase of the first complex vector, and (ii) a phase of the second complex vector. For example, the spectral mask may correspond to any of the alternative binary mask, the ratio mask, and the phase-sensitive mask described above in relation to FIG. 7.

The operations also include processing a frequency domain representation of the first input signal based on the spectral mask to generate one or more driver signals (1008). In some implementations, processing the frequency domain representation of the first input signal based on the spectral mask includes generating an initial spectral mask from the frequency domain representation of multiple frames of the second input signal, performing a spectro-temporal smoothing process on the initial spectral mask to generate a smoothed spectral mask, and performing a point-wise multiplication between the frequency domain representation of the first input signal and the smoothed spectral mask to generate a frequency domain representation of the one or more driver signals. In some implementations, the spectro-temporal smoothing process may itself include one or more of (i) implementing a moving average filter over frequency and (ii) implementing frequency dependent attack release smoothing over time.

The operations of the process 1000 also include driving one or more acoustic transducers using the one or more driver signals to generate an acoustic signal representative of the audio (1010). For example, in some implementations, the acoustic transducers may be speakers disposed on an on-head device worn by a user (e.g., listener 106 of FIGS. 1A-1B).

Figure 11:
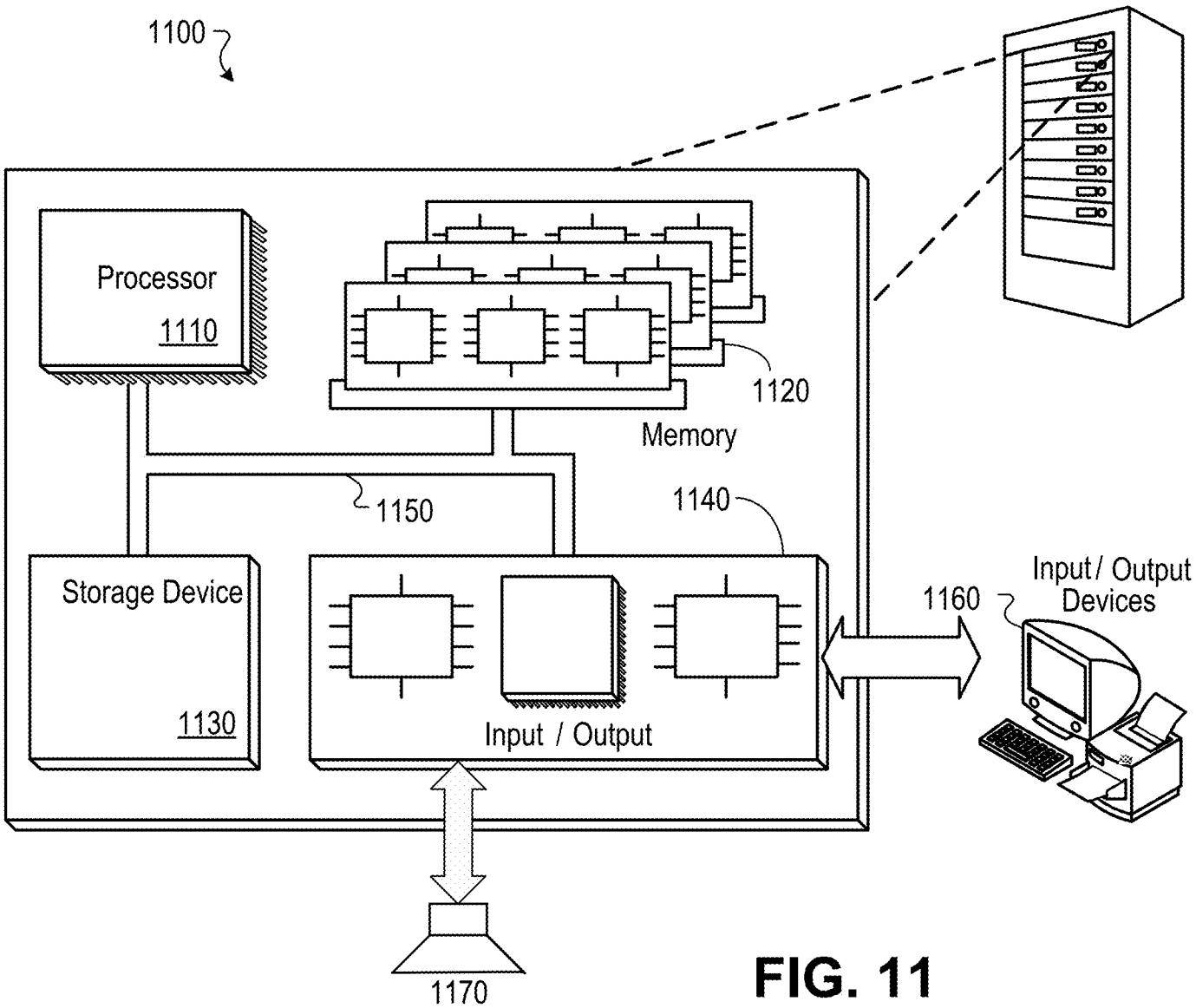
FIG. 11 illustrates an example of a computing device and a mobile computing device that can be used to implement the technology described herein.

FIG. 11 is block diagram of an example computer system 1100 that can be used to perform operations described above. For example, any of the systems and engines described in connection to FIGS. 1, 2, 3A, and 3B can be implemented using at least portions of the computer system 1100. The system 1100 includes a processor 1110, a memory 1120, a storage device 1130, and an input/output device 1140. Each of the components 1110, 1120, 1130, and 1140 can be interconnected, for example, using a system bus 1150. The processor 1110 is capable of processing instructions for execution within the system 1100. In one implementation, the processor 1110 is a single-threaded processor. In another implementation, the processor 1110 is a multi-threaded processor. The processor 1110 is capable of processing instructions stored in the memory 1120 or on the storage device 1130.

The memory 1120 stores information within the system 1100. In one implementation, the memory 1120 is a computer-readable medium. In one implementation, the memory 1120 is a volatile memory unit. In another implementation, the memory 1120 is a non-volatile memory unit.

The storage device 1130 is capable of providing mass storage for the system 1100. In one implementation, the storage device 1130 is a computer-readable medium. In various different implementations, the storage device 1130 can include, for example, a hard disk device, an optical disk device, a storage device that is shared over a network by multiple computing devices (e.g., a cloud storage device), or some other large capacity storage device.

The input/output device 1140 provides input/output operations for the system 1100. In one implementation, the input/output device 1140 can include one or more network interface devices, e.g., an Ethernet card, a serial communication device, e.g., and RS-232 port, and/or a wireless interface device, e.g., and 802.11 card. In another implementation, the input/output device can include driver devices configured to receive input data and send output data to other input/output devices, e.g., keyboard, printer and display devices 1160, and acoustic transducers/speakers 1170.

Although an example processing system has been described in FIG. 11, implementations of the subject matter and the functional operations described in this specification can be implemented in other types of digital electronic circuitry, or in computer software, firmware, or hardware, including the structures disclosed in this specification and their structural equivalents, or in combinations of one or more of them.

This specification uses the term "configured" in connection with systems and computer program components. For a system of one or more computers to be configured to perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the operations or actions.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non transitory storage medium for execution by, or to control the operation of, data processing apparatus. The computer storage medium can be a machine-readable storage device, a machine-readable storage substrate, a random or serial access memory device, or a combination of one or more of them. Alternatively or in addition, the program instructions can be encoded on an artificially generated propagated signal, e.g., a machine-generated electrical, optical, or electromagnetic signal, which is generated to encode information for transmission to suitable receiver apparatus for execution by a data processing apparatus.

The term "data processing apparatus" refers to data processing hardware and encompasses all kinds of apparatus, devices, and machines for processing data, including by way of example a programmable processor, a computer, or multiple processors or computers. The apparatus can also be, or further include, special purpose logic circuitry, e.g., an FPGA (field programmable gate array) or an ASIC (application specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, an app, a module, a software module, a script, or code, can be written in any form of programming language, including compiled or interpreted languages, or declarative or procedural languages, and it can be deployed in any form, including as a stand-alone program or as a module, component, subroutine, or other unit suitable for use in a computing environment. A program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub programs, or portions of code. A computer program can be deployed to be executed on one computer or on multiple computers that are located at one site or distributed across multiple sites and interconnected by a data communication network.

The processes and logic flows described in this specification can be performed by one or more programmable computers executing one or more computer programs to perform functions by operating on input data and generating output. The processes and logic flows can also be performed by special purpose logic circuitry, e.g., an FPGA or an ASIC, or by a combination of special purpose logic circuitry and one or more programmed computers.

Embodiments of the subject matter described in this specification can be implemented in a computing system that includes a back end component, e.g., as a data server, or that includes a middleware component, e.g., an application server, or that includes a front end component, e.g., a client computer having a graphical user interface, a web browser, or an app through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network (LAN) and a wide area network (WAN), e.g., the Internet.

The computing system can include clients and servers. A client and server are generally remote from each other and typically interact through a communication network. The relationship of client and server arises by virtue of computer programs running on the respective computers and having a client-server relationship to each other. In some embodiments, a server transmits data, e.g., an HTML page, to a user device, e.g., for purposes of displaying data to and receiving user input from a user interacting with the device, which acts as a client. Data generated at the user device, e.g., a result of the user interaction, can be received at the server from the device.

Other embodiments and applications not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

While this specification contains many specific implementation details, these should not be construed as limitations on the scope of any claims or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

A number of embodiments have been described. Nevertheless, it will be understood that various modifications can be made without departing from the spirit and scope of the processes and techniques described herein. In addition, the logic flows depicted in the figures do not require the particular order shown, or sequential order, to achieve desirable results. In addition, other steps can be provided, or steps can be eliminated, from the described flows, and other components can be added to, or removed from, the described systems. Accordingly, other embodiments are within the scope of the following claims.

What is claimed is:

1. A method for audio enhancement, the method comprising:

receiving a first input signal representative of audio captured using an array of two or more sensors, the first input signal being characterized by a first signal-to-noise ratio (SNR) wherein the audio is a signal-of-interest;

receiving a second input signal representative of the audio, the second input signal being characterized by a second SNR, with the audio being the signal-of-interest, wherein the second SNR is higher than the first SNR;

computing a spectral mask based at least on a frequency domain representation of the second input signal;

processing a frequency domain representation of the first input signal based on the spectral mask to generate one or more driver signals; and driving one or more acoustic transducers using the one or more driver signals to generate an acoustic signal representative of the audio.

2. The method of claim 1, wherein the frequency domain representation of the second input signal comprises a first complex vector representing a spectrogram of a frame of the second input signal.

3. The method of claim 2, wherein computing the spectral mask comprises:

determining whether a magnitude of the first complex vector satisfies a threshold condition;

responsive to determining that the magnitude of the first complex vector satisfies the threshold condition, setting the value of the spectral mask to the magnitude of the first complex vector; and responsive to determining that the magnitude of the first complex vector fails to satisfy the threshold condition, setting the value of the spectral mask to zero.

4. The method of claim 2, wherein the frequency domain representation of the first input signal comprises a second complex vector representing a spectrogram of a frame of the first input signal.

5. The method of claim 4, wherein computing the spectral mask comprises:

determining whether a magnitude of the second complex vector is larger than a magnitude of a difference between the first and second complex vectors;

responsive to determining that the magnitude of the second complex vector is larger than the magnitude of the difference between the first and second complex vectors, setting the value of the spectral mask to unity; and responsive to determining that the magnitude of the complex vector is less than the magnitude of the difference between the first and second complex vectors, setting the value of the spectral mask to zero.

6. The method of claim 4, wherein computing the spectral mask comprises:

setting the value of the spectral mask to a value computed as a function of a ratio between (i) a magnitude of the first complex vector, and (ii) a magnitude of the second complex vector.

7. The method of claim 6, wherein computing the spectral mask comprises:

setting the value of the spectral mask to value computed as a function of difference between (i) a phase of the first complex vector, and (ii) a phase of the second complex vector.

8. The method of claim 1, wherein processing the frequency domain representation of the first input signal based on the spectral mask comprises:

generating an initial spectral mask from frequency domain representations of multiple frames of the second input signal;

performing a spectro-temporal smoothing process on the initial spectral mask to generate a smoothed spectral mask; and performing a point-wise multiplication between the frequency domain representation of the first input signal and the smoothed spectral mask to generate a frequency domain representation of the one or more driver signals.

9. The method of claim 1, wherein the second input signal originates at a first location that is remote with respect to the array of two or more sensors.

10. The method of claim 1, wherein the second input signal is captured by a sensor disposed at a first location, wherein the first location is closer to a source of the audio as compared to the array of two or more sensors.

11. The method of claim 1, wherein the second input signal is derived from signals captured by a microphone array disposed on a head-worn device.

12. The method of claim 11, wherein the microphone array comprises the array of two or more sensors.

13. The method of claim 11, wherein the second input signal is derived from the signals captured by the microphone array using beamforming or SNR-enhancing techniques.

14. The method of claim 1, wherein the array of two or more sensors comprises microphones disposed in a head-worn device.

15. An audio enhancement system comprising:

an array of two or more sensors, the two or more sensors configured to capture a first input signal representative of audio, the first input signal being characterized by a first signal-to-noise ratio (SNR) wherein the audio is a signal-of-interest;

a controller comprising one or more processing devices, the controller configured to:

receive the first input signal, receive a second input signal representative of the audio, the second input signal being characterized by a second SNR, with the audio being the signal-of-interest, wherein the second SNR is higher than the first SNR, compute a spectral mask based at least on a frequency domain representation of the second input signal, process a frequency domain representation of the first input signal based on the spectral mask to generate one or more driver signals; and one or more acoustic transducers driven by the one or more driver signals to generate an acoustic signal representative of the audio.

16. The system of claim 15, wherein the frequency domain representation of the second input signal comprises a first complex vector representing a spectrogram of a frame of the second input signal.

17. The system of claim 16, wherein computing the spectral mask comprises:

determining whether a magnitude of the first complex vector satisfies a threshold condition;

responsive to determining that the magnitude of the first complex vector satisfies the threshold condition, setting the value of the spectral mask to the magnitude of the first complex vector; and responsive to determining that the magnitude of the first complex vector fails to satisfy the threshold condition, setting the value of the spectral mask to zero.

18. The system of claim 17, wherein the frequency domain representation of the first input signal comprises a second complex vector representing a spectrogram of a frame of the first input signal.

19. The system of claim 18, wherein computing the spectral mask comprises:

determining whether a magnitude of the second complex vector is larger than a magnitude of a difference between the first and second complex vectors;

responsive to determining that the magnitude of the second complex vector is less than a magnitude of a difference between the first and second complex vectors, setting the value of the spectral mask to unity; and responsive to determining that the magnitude of the complex vector fails to satisfy the threshold condition, setting the value of the spectral mask to zero.

20. The system of claim 18, wherein computing the spectral mask comprises:

setting the value of the spectral mask to a value computed as a function of a ratio between (i) a magnitude of the first complex vector, and (ii) a magnitude of the second complex vector.

21. The system of claim 20, wherein computing the spectral mask comprises:

setting the value of the spectral mask to value computed as a function of difference between (i) a phase of the first complex vector, and (ii) a phase of the second complex vector.

22. The system of claim 15, wherein processing the frequency domain representation of the first input signal based on the spectral mask comprises:

generating an initial spectral mask from frequency domain representations of multiple frames of the second input signal;

performing a spectro-temporal smoothing process on the initial spectral mask to generate a smoothed spectral mask; and performing a point-wise multiplication between the frequency domain representation of the first input signal and the smoothed spectral mask to generate a frequency domain representation of the one or more driver signals.

23. The system of claim 15, wherein the second input signal is captured by a sensor disposed at a first location, wherein the first location is closer to a source of the audio as compared to the array of two or more sensors.

24. The system of claim 15, wherein the array of two or more sensors comprises microphones disposed in a head-worn device.

* * * * *